US010874216B2

(12) United States Patent
Grace

(10) Patent No.: US 10,874,216 B2
(45) Date of Patent: Dec. 29, 2020

(54) PORTABLE, COLLAPSIBLE STADIUM SEAT WITH SAFETY LATCH

(71) Applicant: GCI Outdoor, Inc., Higgaum, CT (US)

(72) Inventor: Daniel R. Grace, Old Saybrook, CT (US)

(73) Assignee: GCI Outdoor, Inc., Higganum, CT (US)

( * ) Notice: Subject to any disclaimer, the term of this patent is extended or adjusted under 35 U.S.C. 154(b) by 93 days.

(21) Appl. No.: 16/258,948

(22) Filed: Jan. 28, 2019

(65) Prior Publication Data

US 2019/0231074 A1 Aug. 1, 2019

Related U.S. Application Data

(60) Provisional application No. 62/622,192, filed on Jan. 26, 2018.

(51) Int. Cl.

| | |
|---|---|
| ***A47C 1/16*** | (2006.01) |
| ***A45F 3/14*** | (2006.01) |
| ***A47C 4/28*** | (2006.01) |

(52) U.S. Cl.

CPC ..... *A47C 1/16* (2013.01); *A45F 3/14* (2013.01); *A47C 4/28* (2013.01); *A45F 2003/142* (2013.01)

(58) Field of Classification Search

CPC ..... A47C 1/16; A47C 4/28; A45F 3/14; A45F 2003/142

USPC ..... 297/183.5

See application file for complete search history.

(56) References Cited

U.S. PATENT DOCUMENTS

| | | | | |
|---|---|---|---|---|
| 812,013 | A | 2/1906 | Bower et al. | |
| 2,736,365 | A * | 2/1956 | Hines | A47C 1/16 297/183.5 |
| 3,005,659 | A | 10/1961 | Sanders | |
| 3,120,404 | A * | 2/1964 | Bramming | A45C 9/00 297/118 |
| 3,594,039 | A * | 7/1971 | Harp | A47C 7/66 297/252 |
| 3,929,373 | A | 12/1975 | Gawlinski | |
| 4,063,392 | A * | 12/1977 | Van Ryn | A47C 1/126 52/9 |
| 4,186,959 | A | 2/1980 | Thebaud | |
| 4,300,707 | A | 11/1981 | Kjaer | |
| 4,577,901 | A | 3/1986 | Phillips | |
| 4,720,029 | A | 1/1988 | Varanakis | |
| 4,772,068 | A | 9/1988 | Glecker et al. | |

(Continued)

*Primary Examiner* — Mark R Wendell

(74) *Attorney, Agent, or Firm* — Lathrop GPM LLP; Wm. Tucker Griffith

(57) ABSTRACT

A portable and collapsible stadium seat comprises a seat bottom support, a back support, and a safety latch for properly positioning the seat in place relative to a stadium bleacher seating surface or bench. The seat bottom support and back support are interconnected for movement between an operative, or set-up, condition defining a seating surface and a back support surface, and a collapsed, or bundled, condition designed for easy transport and storage of the seat. The safety latch is movably connected on underside of the seat bottom support, preferably towards the forward end thereof, and provides a stop and an arm facilitating proper and safe positioning of the seat on a bleacher or bench surface for use. The seat preferably includes a carrying strap or handle for transporting the collapsed and bundled seat, for example, over the user's shoulder or via a hand grasp.

21 Claims, 17 Drawing Sheets

(56) References Cited

U.S. PATENT DOCUMENTS

| | | | | |
|---|---|---|---|---|
| 4,824,171 | A | 4/1989 | Hollingsworth | |
| 5,016,792 | A | 5/1991 | Jay | |
| 5,139,308 | A | 8/1992 | Ziman | |
| 5,318,342 | A | 6/1994 | Hale | |
| 5,498,054 | A | 3/1996 | Tomlinson | |
| 5,501,505 | A | 3/1996 | Jablonski | |
| 5,516,193 | A * | 5/1996 | Simpson | A47C 1/16 297/188.01 |
| 5,588,570 | A | 12/1996 | Zirbel | |
| 5,588,696 | A | 12/1996 | Jay et al. | |
| 5,779,314 | A | 7/1998 | Grace | |
| 5,934,751 | A * | 8/1999 | Johnson | A47C 1/16 297/184.1 |
| 6,502,902 | B1 * | 1/2003 | Romero | A47C 1/16 297/352 |
| 6,739,667 | B1 * | 5/2004 | Jones | A47C 1/16 297/230.11 |
| 9,247,817 | B2 * | 2/2016 | Grace | A47C 1/16 |
| 2006/0220428 | A1 * | 10/2006 | Vestweber | A47C 1/16 297/252 |
| 2008/0122268 | A1 | 5/2008 | Kim et al. | |
| 2009/0079244 | A1 * | 3/2009 | Kelleher | A47C 1/16 297/257 |
| 2011/0067428 | A1 * | 3/2011 | Dimmitt | A45C 9/00 62/326 |
| 2016/0066694 | A1 * | 3/2016 | Blakeney | A47C 7/425 297/228.13 |

* cited by examiner

PORTABLE, COLLAPSIBLE STADIUM SEAT WITH SAFETY LATCH

CROSS-REFERENCE TO RELATED APPLICATION

This application claims priority to U.S. Provisional Patent Application No. 62/622,192, filed Jan. 26, 2018, which is hereby incorporated by reference in its entirety.

FIELD OF THE INVENTION

The present invention relates generally to seats, and more particularly relates to seats of portable, collapsible type particularly adapted for use on flat and level supporting surfaces, such as stadium bleachers or benches.

BACKGROUND OF THE INVENTION

Lightweight, portable seats and chairs of a type with which the present invention is concerned are enjoying increasing popularity for use in viewing sports activities, concerts and a wide variety of other outdoor activities such as camping, boating, hunting, fishing and the like, normally lacking adequate preexisting seating accommodations. Such lightweight, portable seats are also desired for use in arenas and stadiums, where spectators typically sit on preexisting bleachers or benches. However, such preexisting seating accommodations often lack sufficient back support for spectators.

Folding chairs are currently available in a wide variety of designs, but generally lack the desired degree of portability for ideal usage. Such folding chairs are especially unsuited for use in arenas and stadiums, where the chairs cannot fit over or around the preexisting bleachers or benches.

Lightweight portable seats are currently available on the market for use on stadium bleachers and benches, but are often difficult to set-up and break down, do not collapse to sufficient small size for transport and storage, and often do not have suitable back support, thereby offering little improvement over the preexisting bleacher or bench. Commonly, such seats comprise just a padded cushion that provides more comfort than a solid bleacher or bench. However, as noted, lightweight portable seats that do not have suitable back support, such as padded cushions, are consequently uncomfortable when used for a prolonged period of time.

Furthermore, portable seats for use on stadium bleachers and benches can also pose problems if not properly positioned on the bleacher surface. For example, if the seat is positioned too far back on the bleacher or bench, the user can easily fall backwards when seated, and especially if the user leans too far backwards on the seat. Often, there is little indication for how best to position such a stadium seat in place, and moreover, no sufficient means to secure the seat in place on the bleacher or bench so as to prevent the user from falling backwards. Likewise, if the seat is positioned too far forward, the user and seat can easily slide off the front of the bleacher.

Some stadium seats on the market include a bracket, often spring-biased and L-shaped, for securing the seat to a bleacher. In use, the bracket is positioned to grasp the underside of the bleacher bench. However, some bleacher seats do not have a sufficient opening under the bleacher bench, and as a result, such a safety bracket cannot be used. Additionally, users often do not use the bracket out of shear laziness. When the bracket is not used, the seat can be easily positioned in the incorrect location on the bleacher—for example, too far back, leading to users falling off the bleacher bench.

In view of the foregoing, there is a need for a lightweight, portable seat that can be easily collapsed into a small bundle for transport and storage, and as easily set-up for use as a seat. There is also a need for such a seat that provides sufficient back support for a user, especially in a situation where preexisting seating accommodations either don't exist, or do not provide any back support for a seated spectator. There is further a need for such a seat that positions the seat in a proper and safe position on a stadium bleacher or bench for use with reduced risk of the user falling over when seated.

Accordingly, it is the general aim of the present invention to provide an improved, lightweight, portable, and collapsible seat intended for use on a level surface, such as a stadium bleacher or a bench, which provides back support for a user, and which further is easily collapsible into and retained in a compact bundle for transport and storage. It is a further aim of the present invention to provide a seat having a back support and arms that do not affect or interfere with the collapsing of the seat to a bundled condition or the set-up of the seat into an open, set-up condition, and which further do not compromise the size of the bundled condition of the seat for transport and storage.

Accordingly, it is a general object of the present invention to provide a portable and collapsible stadium seat that overcomes the problems and drawbacks associated with stadium seats, and therefore significantly improves the utility of such seat in the set-up condition on a stadium bleacher or bench while permitting easy transportation and/or storage in a collapsed condition.

SUMMARY OF THE INVENTION

In accordance with embodiments of the present invention, a portable and collapsible stadium seat generally comprises a seat bottom support, a back support, and a safety latch for properly positioning the seat in place relative to a stadium bleacher seating surface or bench. The seat bottom support and back support are interconnected for movement between an operative, or set-up, condition defining a seating surface and a back support surface, and a collapsed, or bundled, condition designed for easy transport and storage of the seat. The seat preferably includes a carrying strap or handle for transporting the collapsed and bundled seat, for example, over the user's shoulder or via a hand grasp.

A safety latch is provided for assisting in positioning the stadium seat relative to the seating surface on which it is placed, and is generally moveable between a retracted position and an extended position, though the seat can be used in accordance with the present invention in either such position. More particularly, the safety latch is pivotally connected on the underside of the seat bottom support, preferably towards the forward end of the seat bottom support, and provides a first stop surface and a rearward facing arm facilitating proper and safe positioning of the seat on a bleacher or bench surface for use. In this regard, the stadium seat in accordance with the present invention is adaptable for use with a variety of bleacher or bench designs. Moreover, the safety latch of the present invention prevents a user from placing the seat too far back on the bleacher seating surface, whether the safety latch is pivoted for use or not, which provides a safety check when a user may be too lazy to engage the safety latch.

In a first mode of use for the safety latch, a first stop is used to position the seat whereby the seat is slid back on a generally horizontal seating surface of the bleacher seat until the first stop contacts a front face of the bleacher seat. This mode is especially useful if the bleacher seat has no opening in the front face. Moreover, the first stop extends beyond the lower plane of the seat bottom support such that if the seat is positioned too far back on the horizontal seating surface of the bleacher, the stadium seat will not be able to sit flush and will wobble on the downwardly projecting stop, making the seat uncomfortable to sit in and essentially alerting the user to reposition the seat.

In a second mode of use, the safety latch can be pivoted to a "down" or extended position, preferably through a 90 degree rotation, whereby an arm of the latch projects rearward such that it can extend through any opening on the front face of the bleacher bench and be positioned beneath and contact the underside of the bench to both properly position the stadium seat on the bleacher and the secure the seat in place once positioned. The seat is slid back until the first stop surface contacts the front face of the bleacher bench. As so positioned, the safety latch alerts the user to the proper position for the seat and also help keep the seat from leaning or sliding backwards when the user happens to lean back on the back support of the seat. In embodiments of the present invention, the safety latch can be spring-biased to its "up" or "rest" or retracted position, such that when it is pivoted down, the bias will aide in the safety latch (and rearwardly extending arm portion thereof) pinching the bench to hold the seat in place once positioned.

A second stop is provided to control the movement of the safety latch. That is, when the safety latch is in its retracted position, the second stop interacts with frame structure of the seat bottom support to keep it in the desired position. Similarly, the second stop restricts the extent of pivoting movement of the safety latch to its extended position, again, by interacting with the frame structure of the seat bottom support.

In a first aspect of the present invention, a portable and collapsible seat having set-up and collapsed conditions comprises a seat bottom support frame and a back support frame with respective flexible fabric panels defining a seat and a back support. In preferred embodiments of the present invention, the back support is pivotable relative to the seat bottom support so that it is disposed in general parallel relationship with the seat bottom support when the seat is collapsed and generally normal to the seat bottom support when the seat is set-up for use.

In one embodiment of the present invention, a pair of armrests is provided, each armrest being pivotable with movement of the back support between a collapsed condition and a set-up condition.

In another embodiment of the present invention, the carrying strap is attached to the seat bottom support on each side and wrapped around the back support. When the seat is in its set-up condition, the strap positions and supports the back support relative to the seat bottom support. More particularly, the strap may be routed through loops provided on the backside, and more preferably, the upper backside, of the back support, and as so routed helps tension the back support during use of the seat. When the seat is folded and collapsed, the strap is relaxed and acts as a carrying strap for easy transport of the folded seat.

The seat of the present invention may further include add-on features, such as a beverage holder and storage pockets, that help to enhance the spectator's experience while using the seat.

These and other objects, features and advantages of the present invention will become apparent in light of the detailed description of embodiments thereof, as illustrated in the accompanying drawings.

DETAILED DESCRIPTION OF PREFERRED EMBODIMENTS

Figure 1:
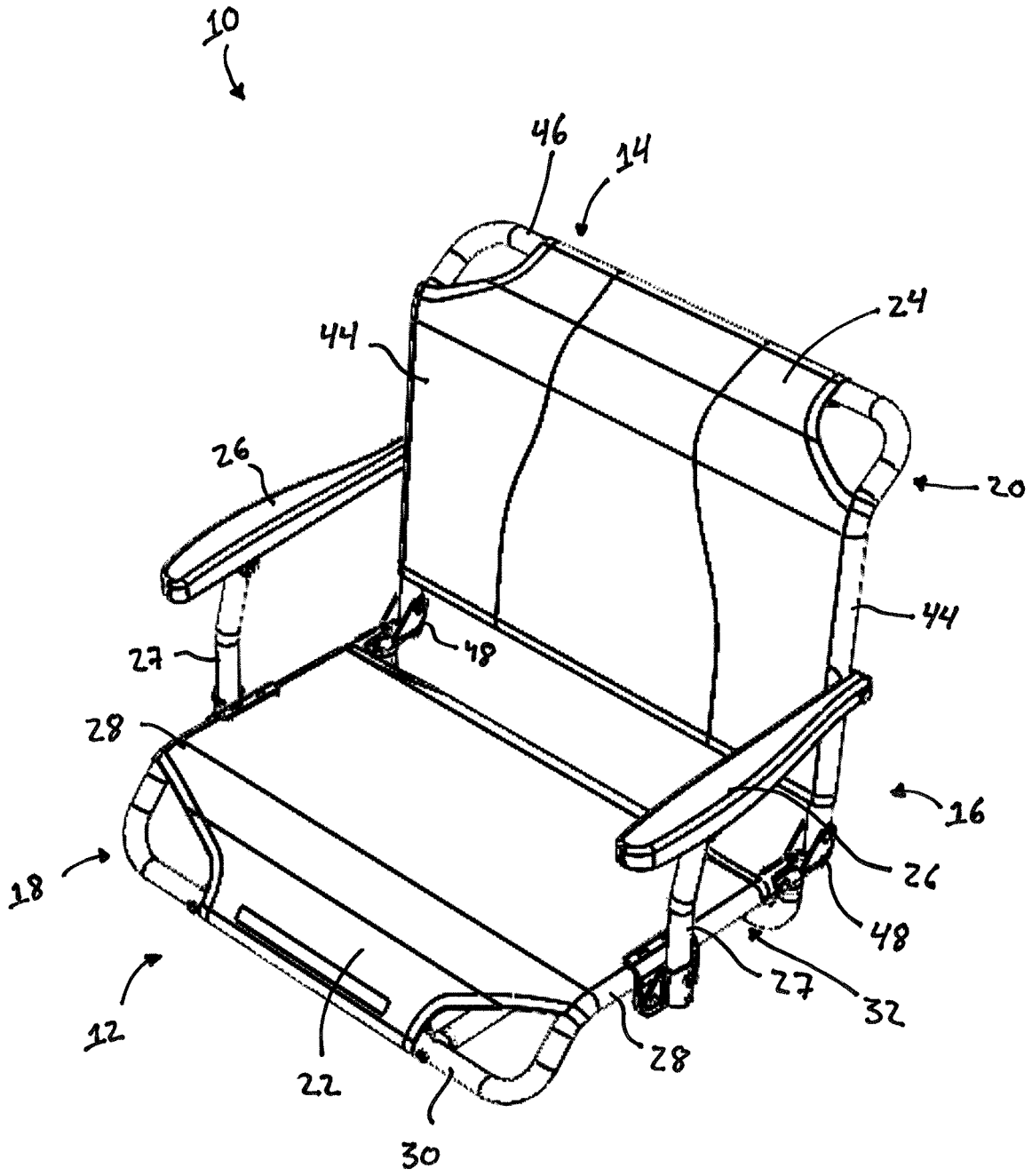
FIG. 1 is a front perspective view of a portable and collapsible stadium seat in accordance with an embodiment of the present invention shown in a set-up condition.
Figure 2:
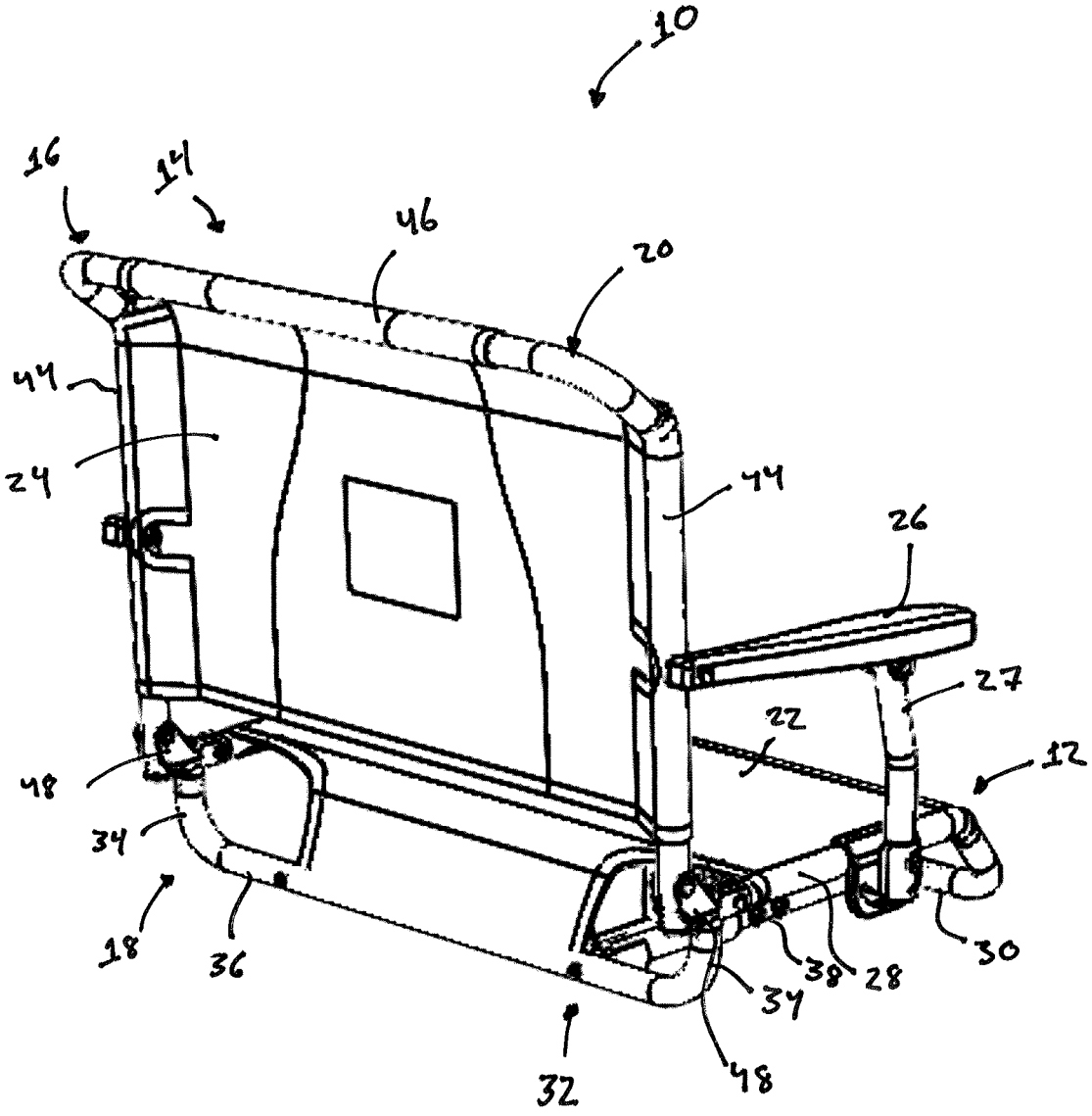
FIG. 2 is a rear perspective view of the stadium seat of FIG. 1.
Figure 20:
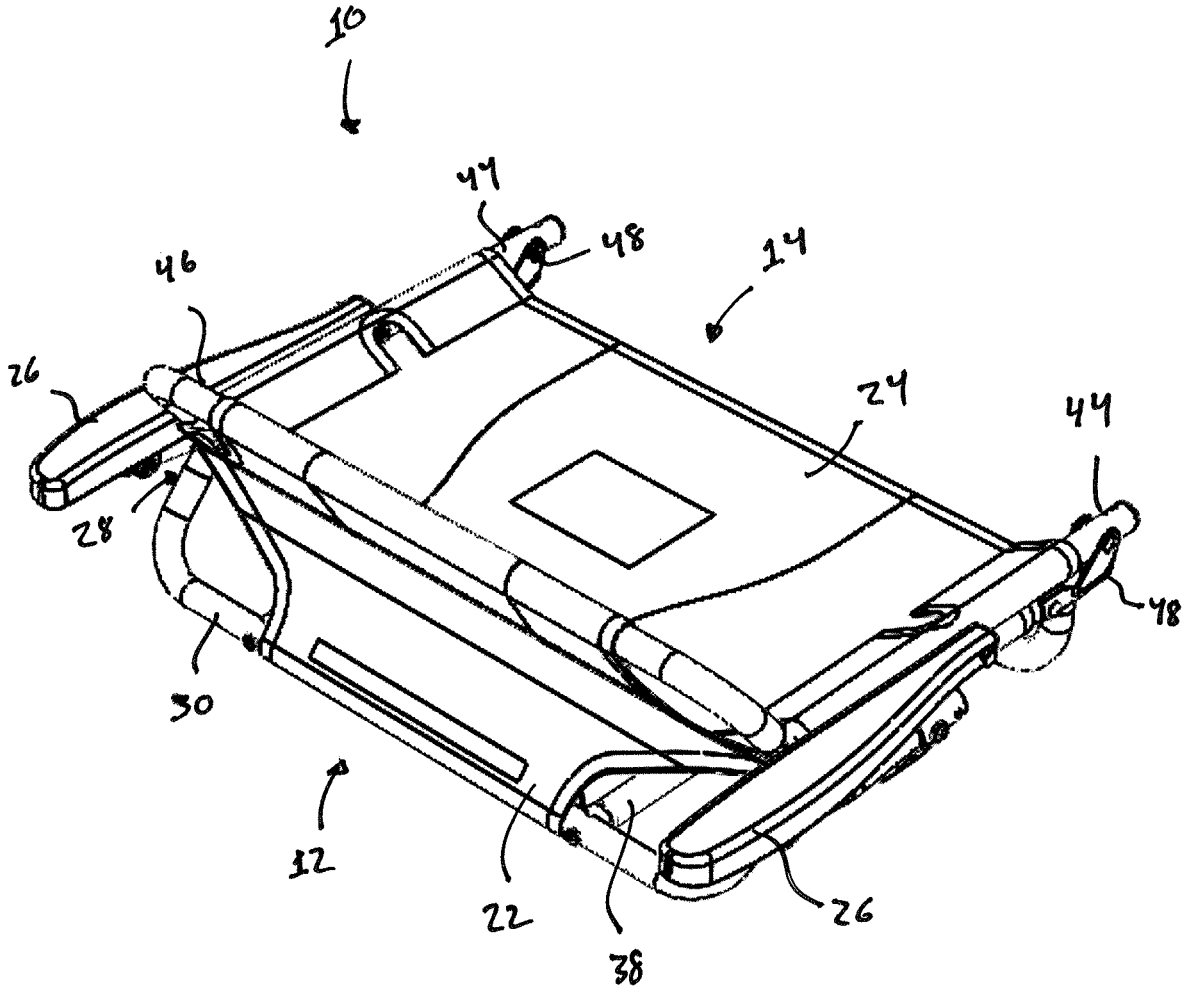
FIG. 20 is a front perspective view of the stadium seat of FIG. 1 shown in a collapsed condition.

Turning now to the drawings, a portable and collapsible stadium seat embodying the present invention, generally designated by reference numeral 10, is shown in FIGS. 1-2 in its operative, or set-up, condition and in FIG. 20 in its collapsed, or bundled, condition. The seat 10 is especially suitable for use in arenas and stadiums for spectator events, such as sporting events and concerts, where preexisting seating accommodations typically comprise level surfaces, such as bleachers and benches, that are hard and have little or no back support. Still further, the seat 10 can be used on other level surfaces, such as the ground or a floor, to provide a seat with sufficient back support for enjoying a variety of spectator events, such as sporting events, concerts, and fireworks displays, and a variety of other activities such as camping, boating, hunting, fishing and the like, where such events and activities normally lack any adequate preexisting seating accommodations.

The seat 10 generally comprises a seat bottom support 12 and a back support 14 interconnected together for movement between the set-up and collapsed conditions. As shown in FIG. 1, the seat 10 has a foldable frame 16 comprised generally of a seat bottom frame 18 defining a seating surface and a back support frame 20 defining a back support surface, which respectively support flexible seat and back panels 22 and 24 made from fabric, padding, or other suitable material (preferably including a material that is durable and waterproof). Accordingly, as illustrated in the embodiment of FIG. 1, the seat bottom support 12 comprises the seat bottom frame 20 and the seat panel 22 attached thereto. Similarly, the back support 14 comprises the back support frame 20 and the back panel 24 attached thereto. Alternate designs of either the seat bottom support 12, or the back support 14, or both, are available without departing from the principles and spirit of the present invention. For example, instead of a fabric panel for the seating and/or back supporting surfaces, a padded support can be used.

As further shown in FIG. 1, in a preferred embodiment, the seat 10 further comprises two armrests 26 pivotally connected to the seat bottom frame 18 and the back support frame 20 for movement relative thereto and for collapsing with the seat 10.

As shown in FIGS. 12-19, the seat 10, when set-up, may sit atop the preexisting seating surface (e.g., a stadium bleacher or bench, generally designated by reference numeral 200), and define a seating accommodation for the user that improves upon the comfort of the preexisting seating surface of the bleacher 200, for example, by preferably providing a comfortable seat bottom support 12, a back support 14 that the user can lean on, and two armrests 26, that are not generally provided as part of the standard stadium bleacher 200. These components of the seat 10 are interconnected for easy and simple folding to a collapsed and bundled condition, such as shown in FIG. 20, for easy transport and storage. The interconnection of the seat components, as generally described and shown herein, further facilitates easy and simple set-up of the seat 10 for use.

Various materials and construction methods may be employed in making the foldable stadium seat 10 of the present invention. However, in accordance with presently preferred embodiments, the seat bottom frame 18 and the back support frame 20 are formed from durable lightweight tubular metal. As illustrated in FIGS. 1-6, the seat bottom frame 18 comprises a generally U-shaped tubular bottom frame which includes a pair of parallel side portions 28 and a transverse front portion 30 integrally connected to the forward ends of said side portions 28 and extending laterally therebetween. As further illustrated, the front portion 30 is preferably downwardly bent so that the seating portion of the seat bottom frame 18—namely, where the seat panel 22 is extended between the parallel side portions 28 of the seat bottom frame 18—is suspended above the surface on which the seat 10 is positioned. The free rearward ends of the side portions 28 are pivotally attached to the back support frame 20, as further discussed below.

Figure 5:
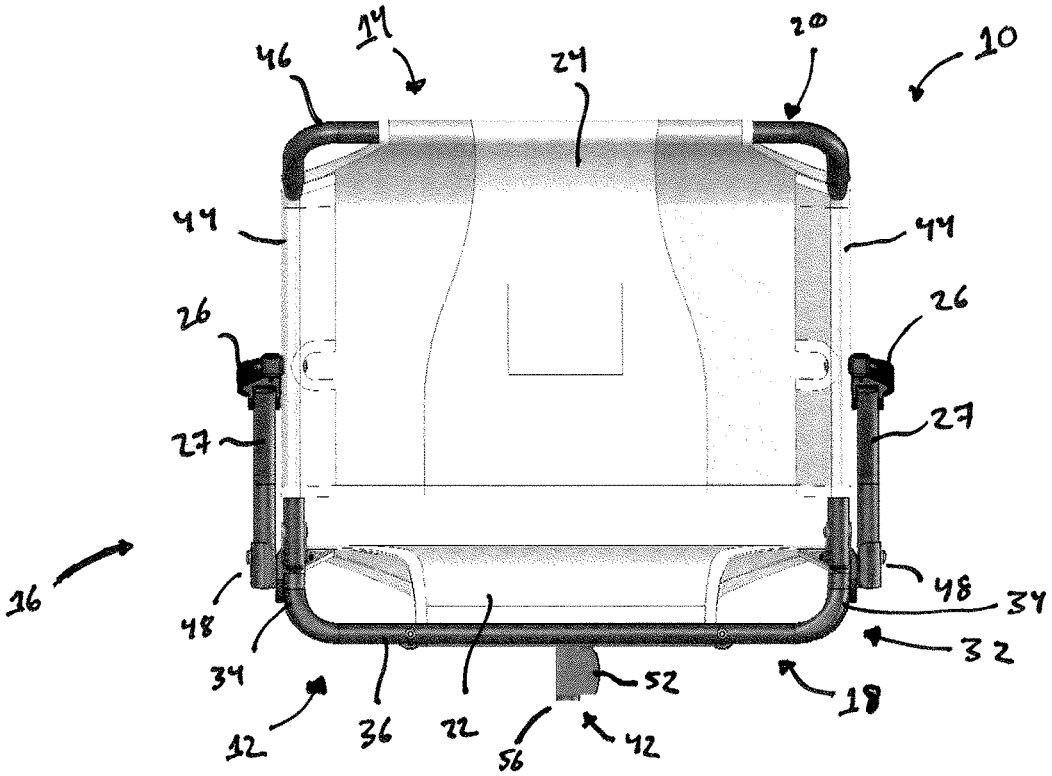
FIG. 5 is a rear planar view of the stadium seat of FIG. 1 with the safety latch in its "down" or extended position.
Figure 6:
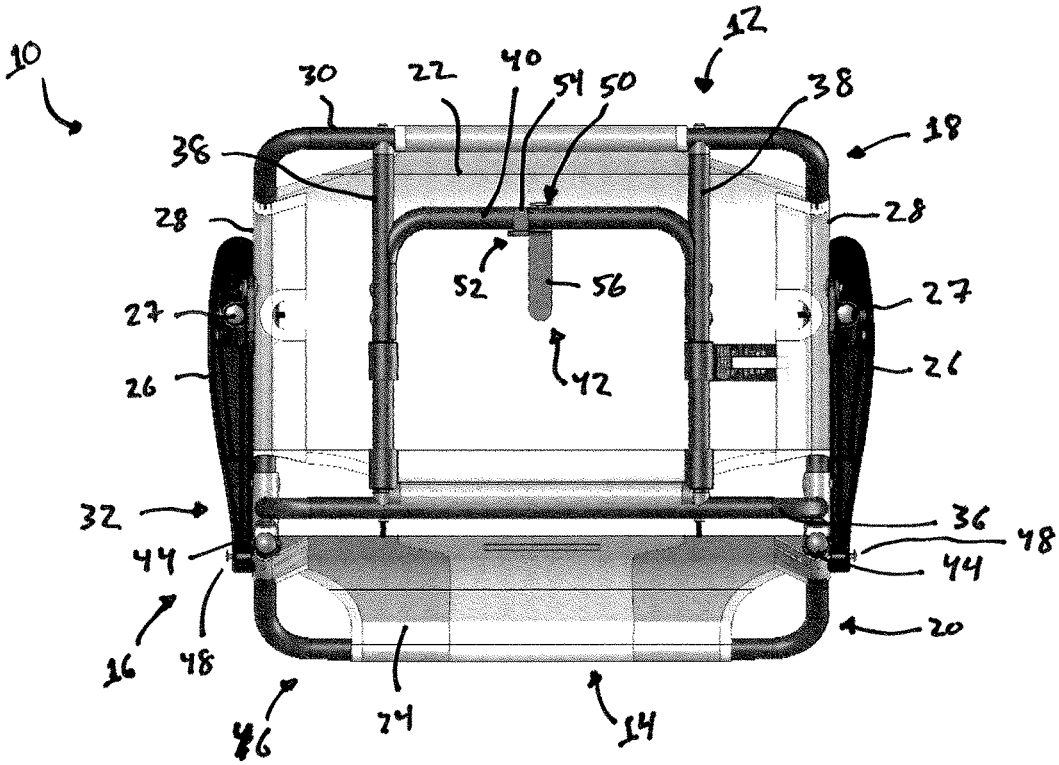
FIG. 6 is a bottom planar view of the stadium seat of FIG. 1 with the safety latch in its "down" or extended position.

As best shown in FIG. 5, a generally U-shaped rear frame member 32 extends downwardly from the free rearward ends of the side portions 28 and defines two rear support legs 34 and a transverse connecting portion 26 connected to and extending between the lower ends of the rear support legs 34. The rear frame member 32 is connected to the transverse front portion 30 of the seat bottom frame 18 by parallel supports 38 running front-to-back, which, in use, rest on the horizontal surface on which the seat 10 is positioned, such as illustrated, for example, in FIG. 13. These parallel supports 38 are braced with a cross-member 40 to which a safety latch 42 in accordance with the present invention is pivotally attached, as illustrated in FIG. 6.

Figure 3:
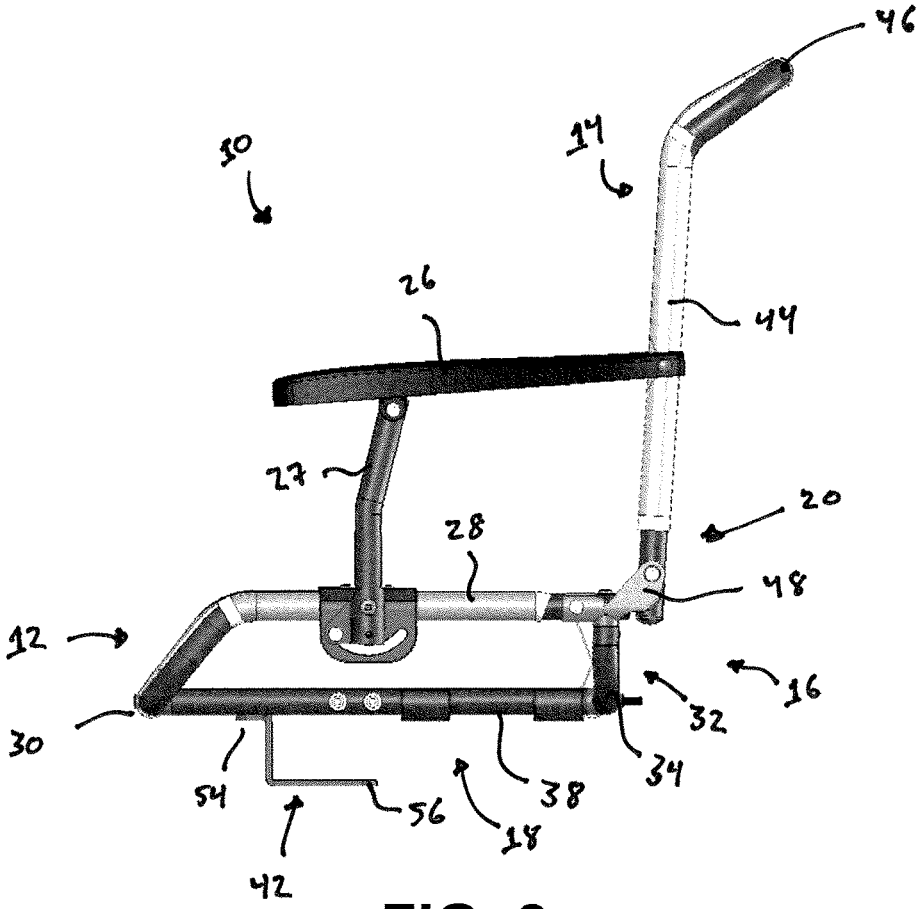
FIG. 3 is a side planar view of the stadium seat of FIG. 1 with a safety latch in accordance with the present invention in a "down" or extended position.
Figure 4:
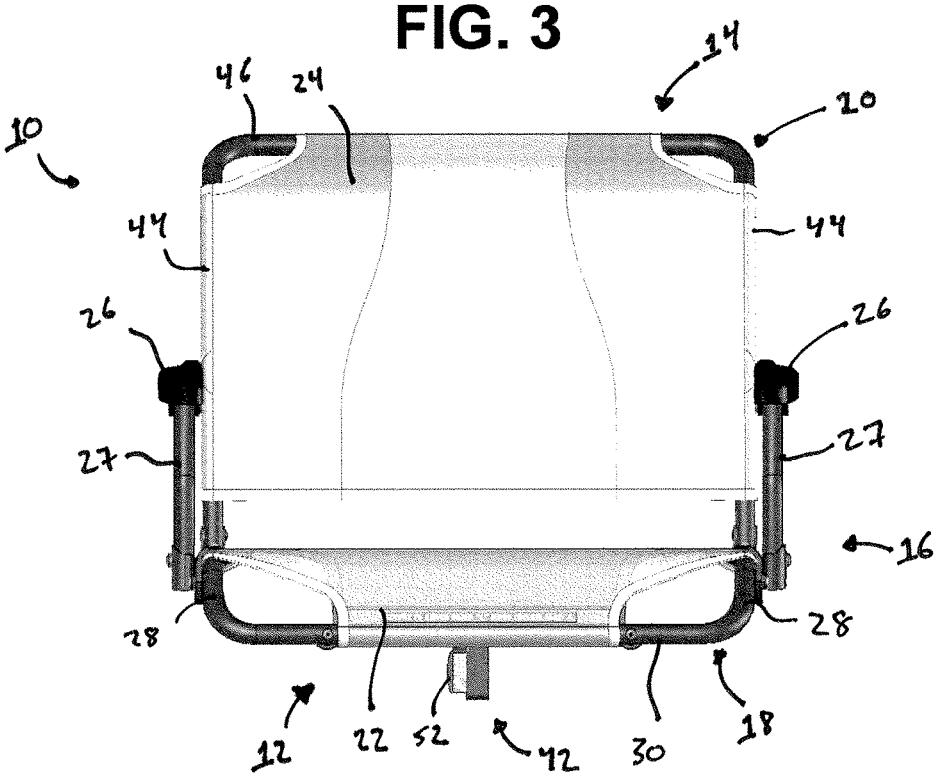
FIG. 4 is a front planar view of the stadium seat of FIG. 1 with the safety latch in its "down" or extended position.

The back support frame 20 comprises a generally U-shaped tubular back frame member similar to the seat bottom frame member and includes a pair of back side members 44 integrally connected at their respective upper ends by a transverse upper connecting member 46. This upper connecting member 46 can be arched backwards, as illustrated in FIG. 3, so as not to interfere with the comfort of a seated user, especially when leaning back on the back support 14. The free lower end portions of the U-shaped back support frame side members 44 generally abut or straddle the free rearward end portions of the U-shaped seat bottom frame side portions 28 and are pivotally connected thereto by pivot brackets 48 to facilitate movement of the back support 14 relative to the seat bottom support 12.

As noted, the back support 14 of the seat 10 is pivotally disposed relative to the seat bottom support 12. In the operative set-up condition of the seat 10, the back support 14 extends generally upwardly from a rear portion or edge of the seat bottom support 12 and is capable of pivotal movement relative to the seat bottom support 12 for collapsing the seat 10 to its collapsed condition. As previously noted, a set-up condition of the seat 10 is illustrated in FIGS. 1-2, while a collapsed condition of the seat 10 is illustrated in FIG. 20. In accordance with the illustrated embodiment, the armrests 26 are pivotable with movement of the back support 14 between the collapsed condition and the set-up condition. In this regard, each armrest 26 is pivotally connected at a rear end to the back support 14 and at a forward end to the seat bottom support 12 via a support member 27.

Figure 7:
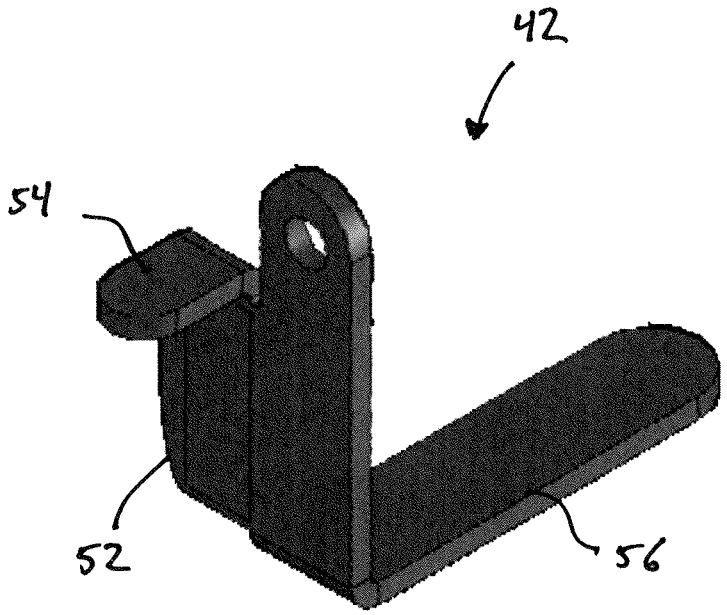
FIG. 7 is a perspective view of an embodiment of a safety latch in accordance with the present invention.
Figure 8:
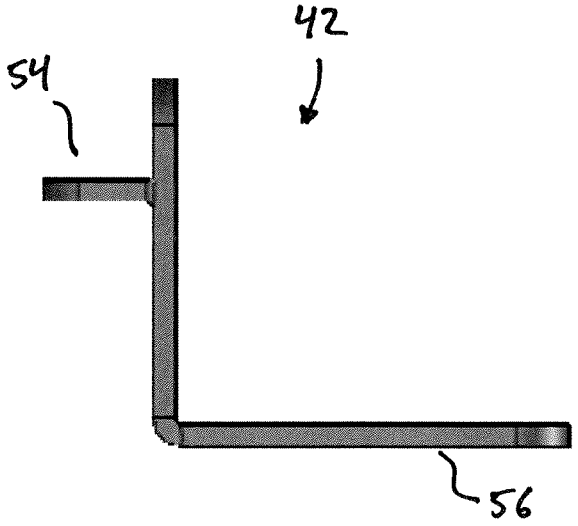
FIG. 8 is a side planar view of the safety latch of FIG. 7.
Figure 9:
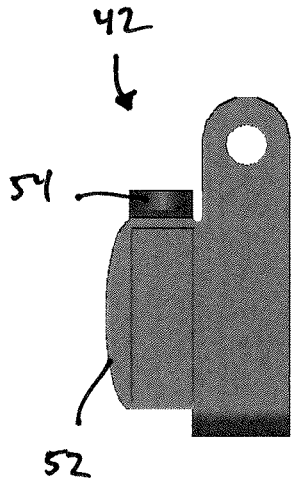
FIG. 9 is a front planar view of the safety latch of FIG. 7.

Referring to FIGS. 7-9, a preferred embodiment of the safety latch 42 in accordance with the present invention for positioning the seat 10 on and relative to a stadium bleacher or bench is illustrated. The safety latch 42 is pivotally attached to the seat bottom frame 18, generally to the underside thereof and more preferably at a forward end thereof for movement between a retracted position and an extended position. More preferably, the safety latch 42 is pivotally attached to the seat bottom frame 18 via a pivot pin 50. Referring to FIG. 6, the safety latch 42 is pivotally attached to the cross-member 40 of the seat bottom frame 18.

As illustrated, for example, in FIG. 6, the latch 42 is centrally located under the seat bottom frame 18 between the sides of the seat 10 so as to best position the seat 10 relative to an expected user's center of mass. As so positioned and attached, the latch 42 can move between its two preferred operational modes or positions—a first "up" or "rest" or retracted position; and a second "down" or extended position. Optimally, the safety latch 42 can be used in either position, as stadium bleachers and benches come in various designs, so that the seat 10 with safety latch 42 in accordance with the present invention has utility regardless of the type of stadium bleacher or bench it is used with. The first "up" position is the preferred position of the latch 42 when the seat 10 is folded, collapsed and generally not in use. However, this first position can also be used to position the seat 10 on bleacher designs that do not have an opening in the front face. A first stop or projection 52 is provided on the latch 42 that projects downward from the seat bottom frame 18 when the latch 42 is in the retracted position and is laterally aligned (side-to-side) with the seat 10 in its set-up condition. The first stop 52 can abut the front face of the bleacher bench 200 when the seat 10 is positioned thereon for use. Ideally, the seat 10 is placed on the horizontal seating surface of the bench 200 and slid back until the first stop 52 contacts the front face and restricts further backward movement of the seat 10. This position of the seat 10 is an optimal location to account for the weight and center of mass of a seated user, even if leaning back on the back support 14 when seated.

Figure 10:
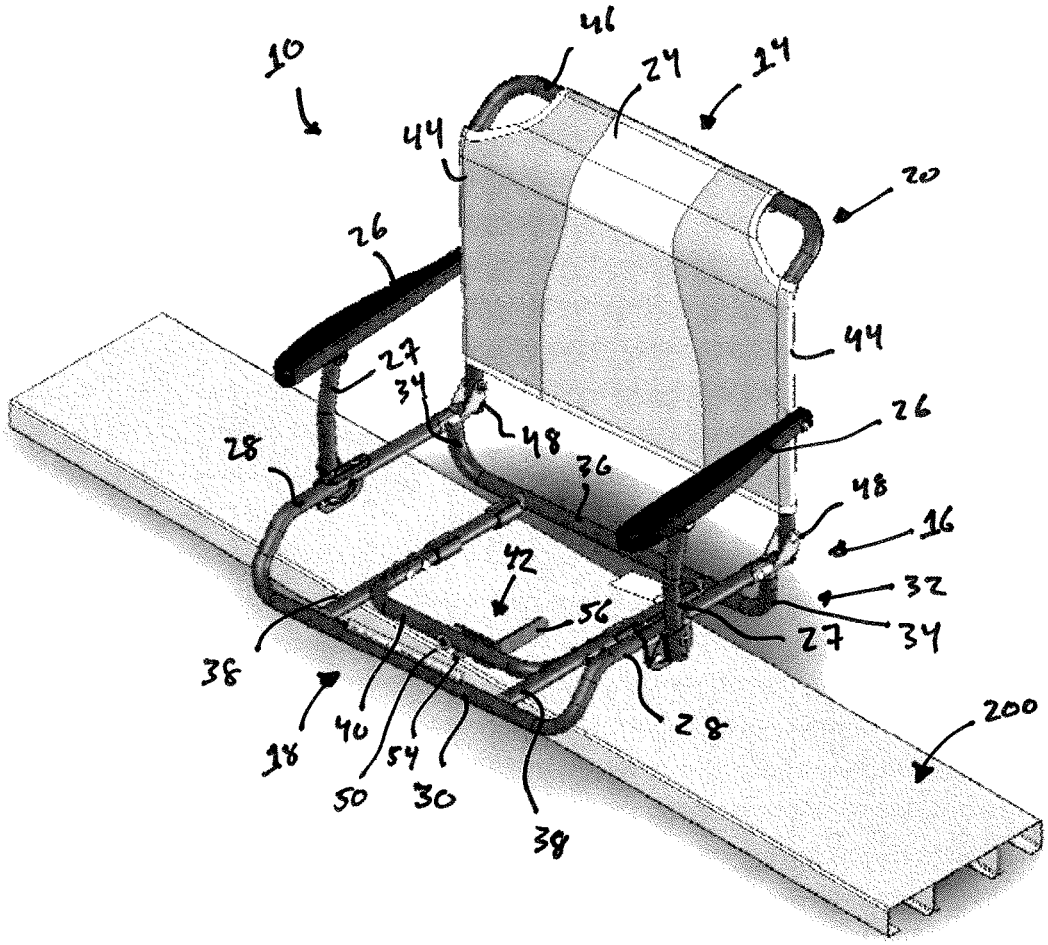
FIG. 10 is a perspective view of the stadium seat of FIG. 1 with the safety latch in its "up" or retracted position incorrectly positioned on a bleacher bench. The seat panel has been removed for illustration purposes.
Figure 11:
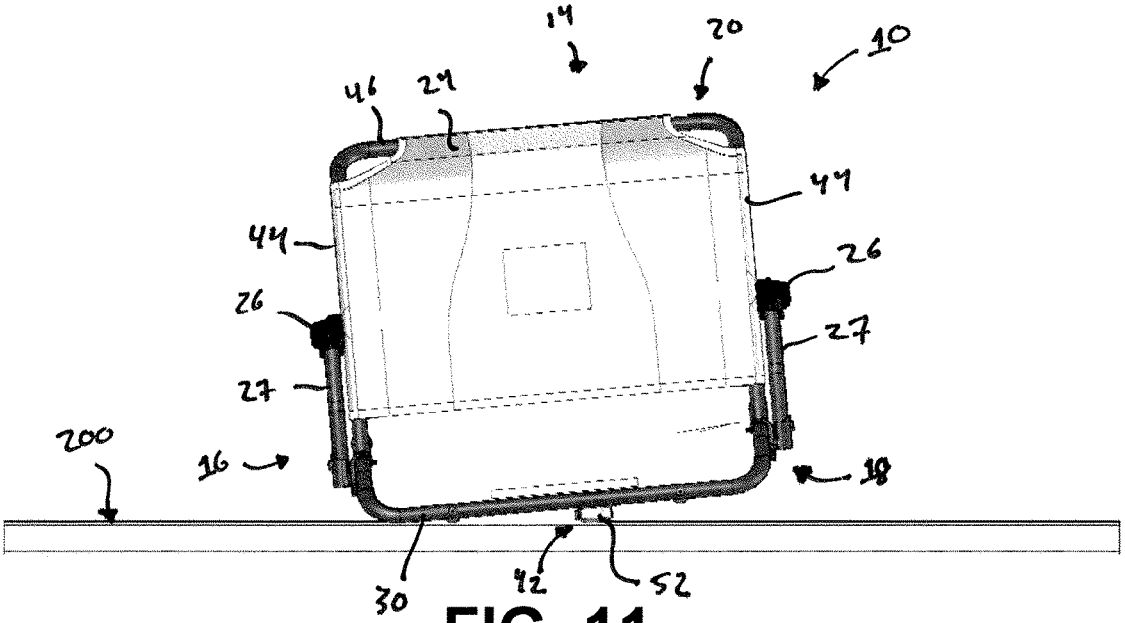
FIG. 11 is a front view of the stadium seat of FIG. 1 as positioned in accordance with FIG. 10.

In a preferred embodiment, the first stop 52 projects downwardly from the seat bottom frame 18 beyond the support plane of the seating and support frames. In this regard, if the seat 10 is placed on the bleacher surface 200 too far back, the first stop 52 will inhibit the seat 10 from sitting flush on the bleacher 200, as illustrated in FIGS. 10-11—making the seat 10 wobble and uncomfortable to sit in. This wobbling alerts the user that the seat 10 is not in an optimal or safe position, and essentially requires the user to reposition the seat 10 properly (and possibly make use of the safety latch 42 if the bleacher design will accommodate it in its "down" or extended position).

Figure 12:
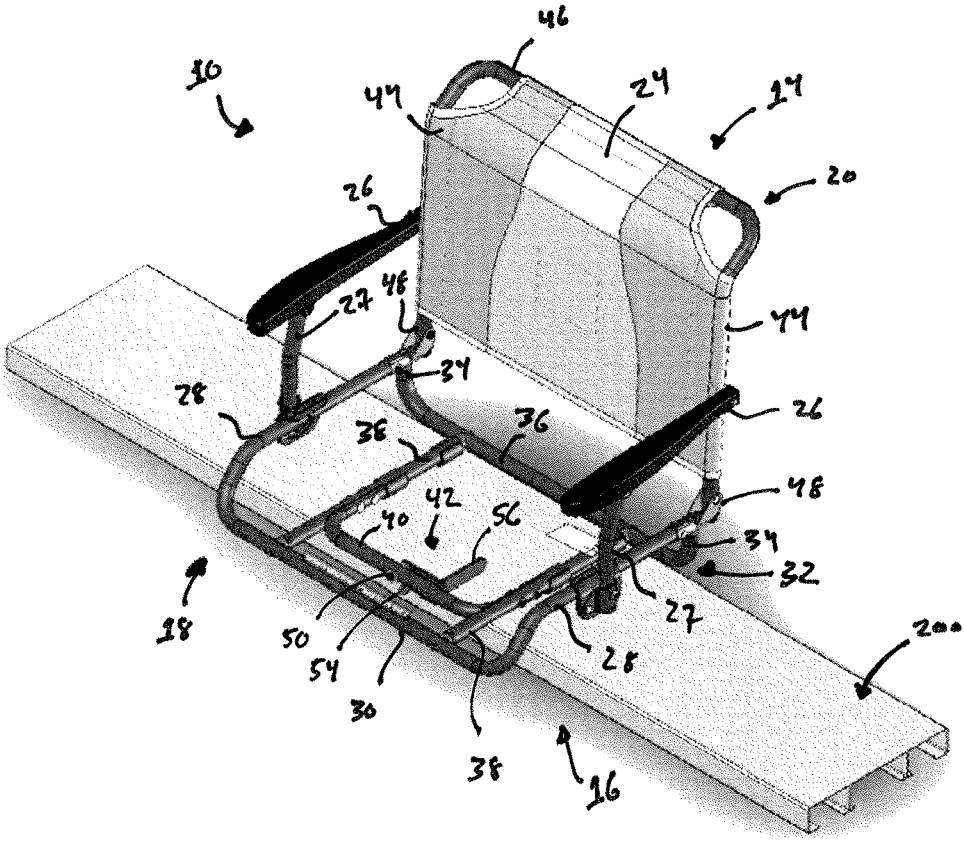
FIG. 12 is a perspective view of the stadium seat of FIG. 1 with the safety latch in its "up" or retracted position as correctly positioned on a bleacher bench. The seat panel has been removed for illustration purposes.
Figure 13:
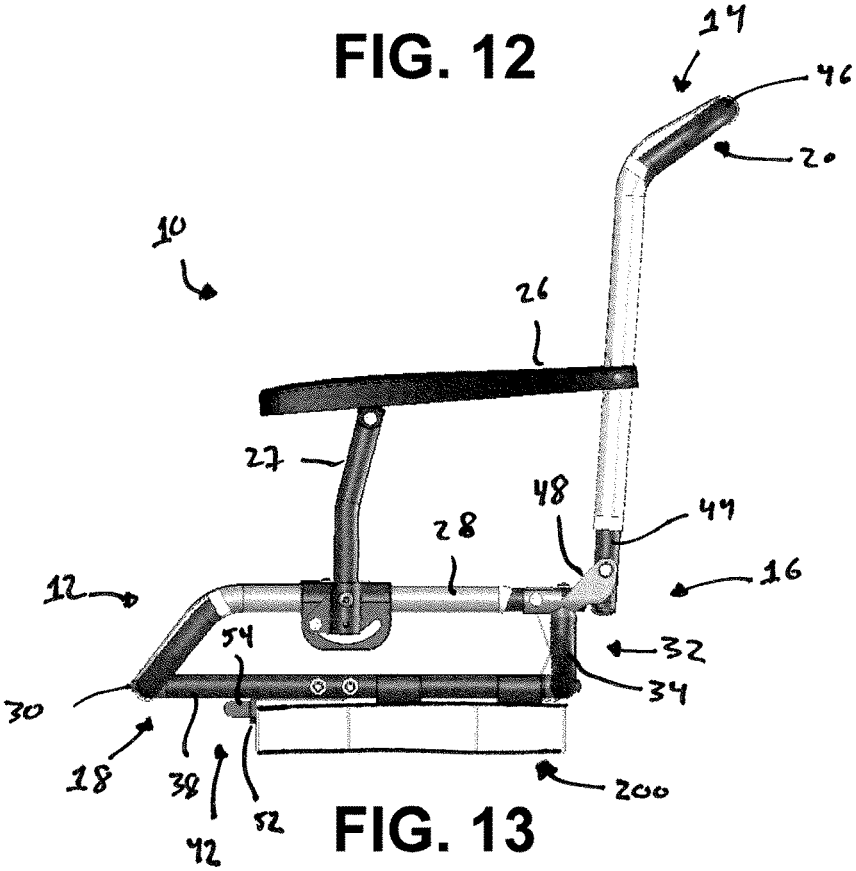
FIG. 13 is a side planer view of the stadium seat of FIG. 1 as positioned in accordance with FIG. 12.
Figure 14:
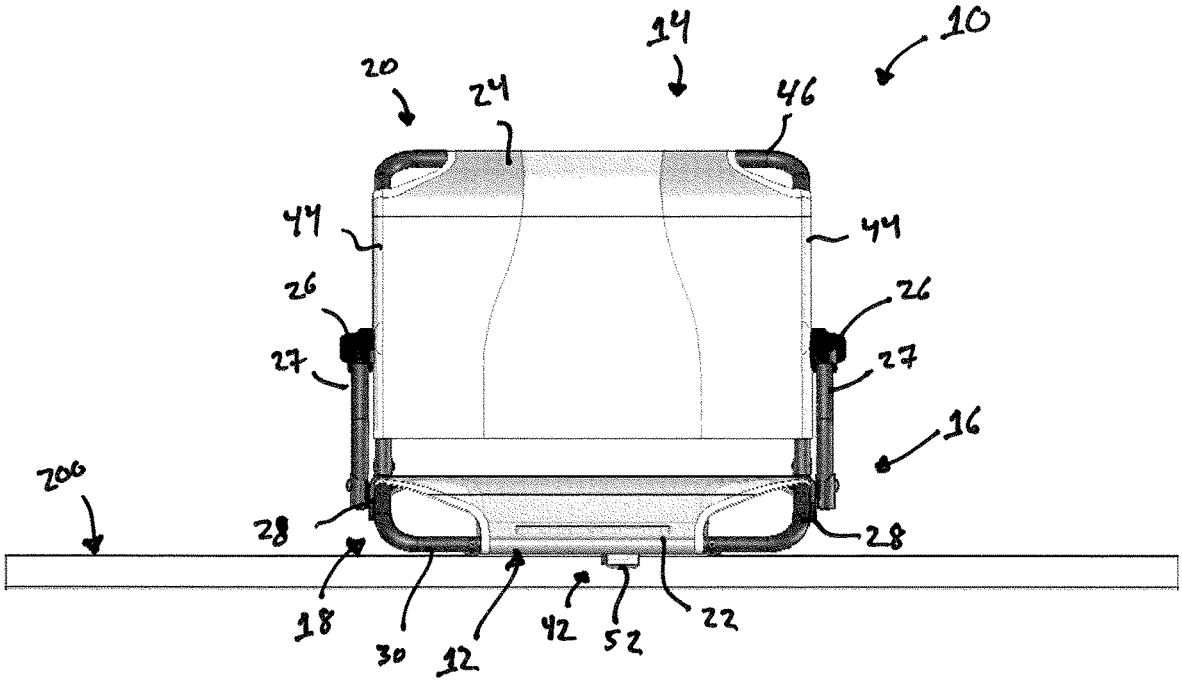
FIG. 14 is a front planar view of the stadium seat of FIG. 1 as positioned in accordance with FIG. 12.
Figure 15:
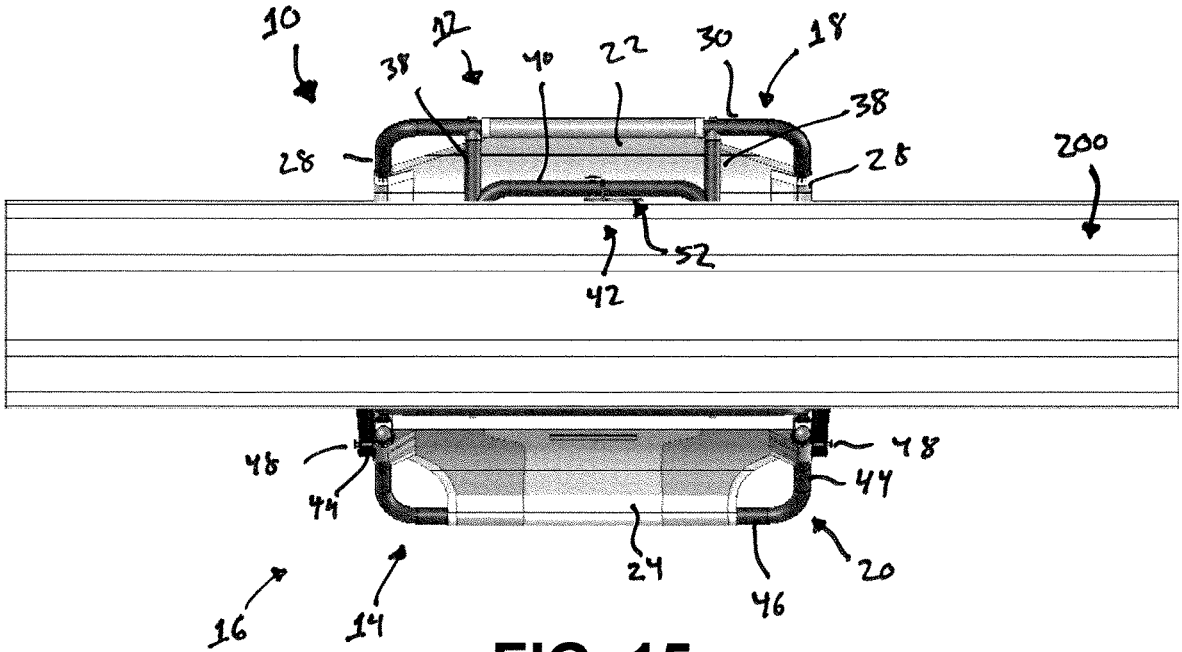
FIG. 15 is a bottom planar view of the stadium seat of FIG. 1 as positioned in accordance with FIG. 12.
Figure 16:
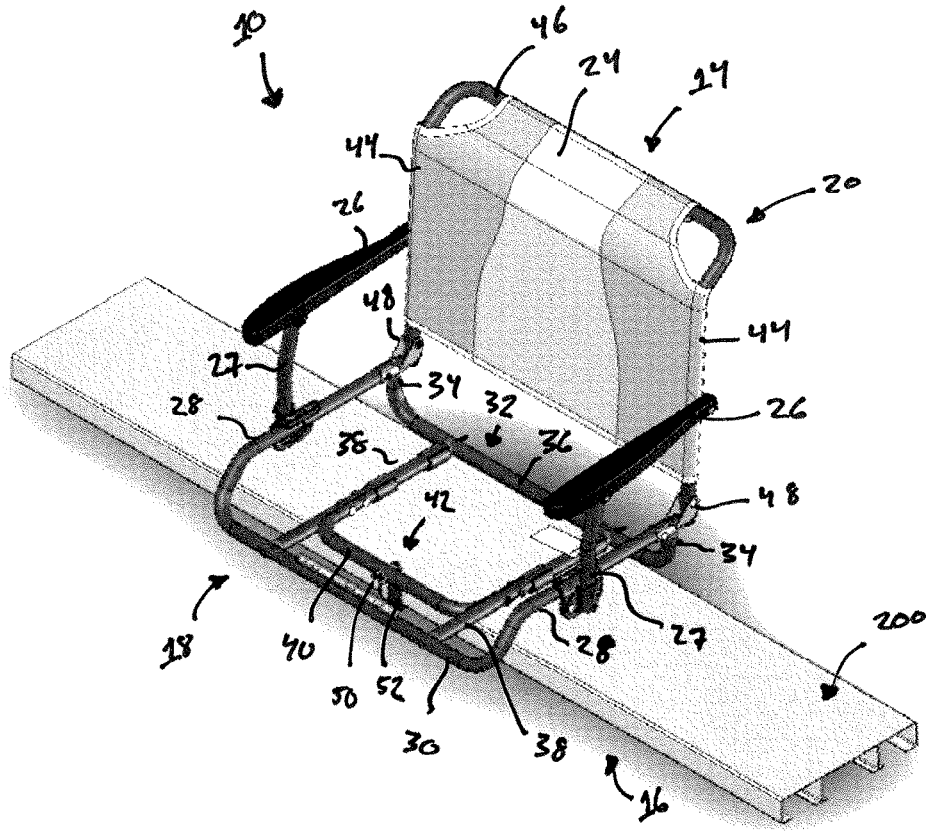
FIG. 16 is a perspective view of the stadium seat of FIG. 1 with the safety latch in its "down" or extended position as correctly positioned on a bleacher bench. The seat panel has been removed for illustration purposes.
Figure 17:
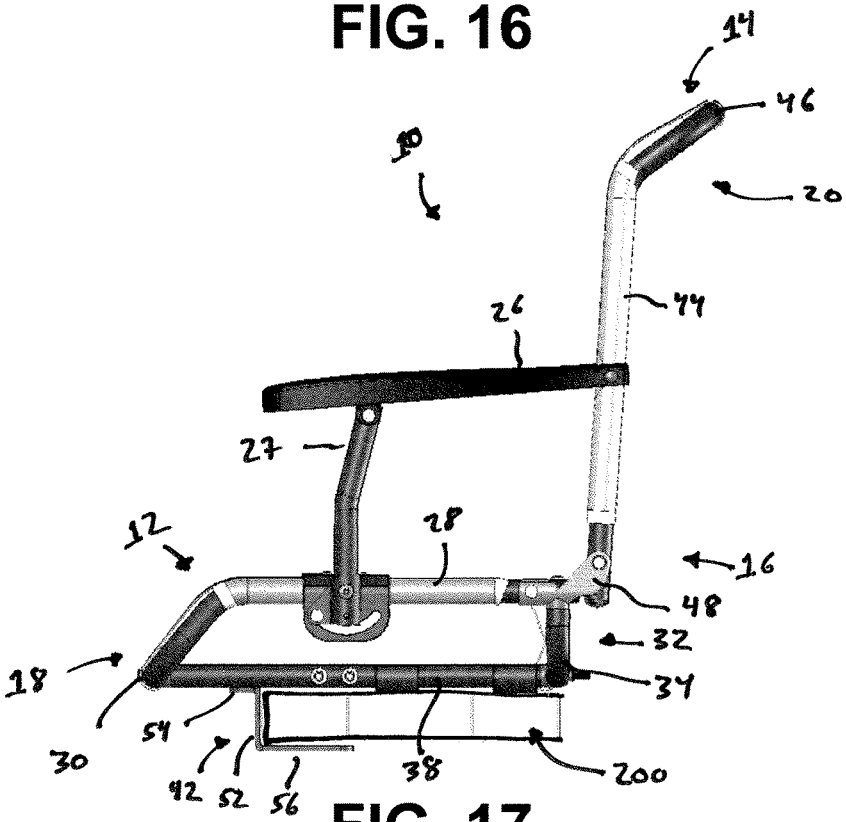
FIG. 17 is a side planer view of the stadium seat of FIG. 1 as positioned in accordance with FIG. 16.
Figure 18:
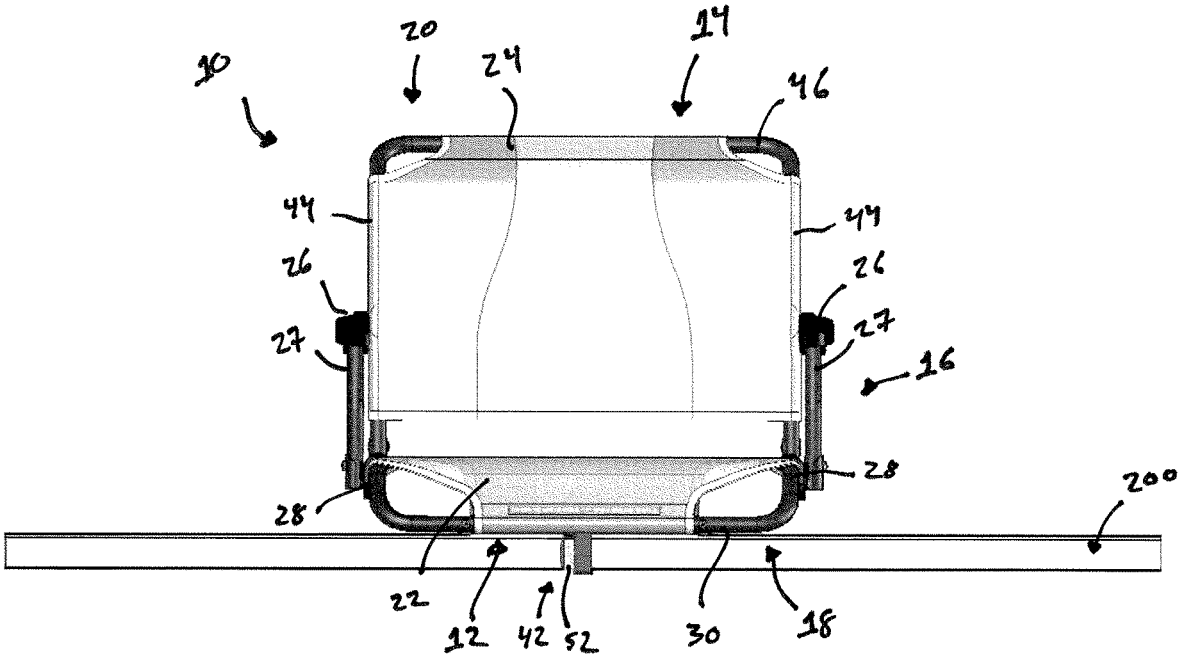
FIG. 18 is a front planar view of the stadium seat of FIG. 1 as positioned in accordance with FIG. 16.
Figure 19:
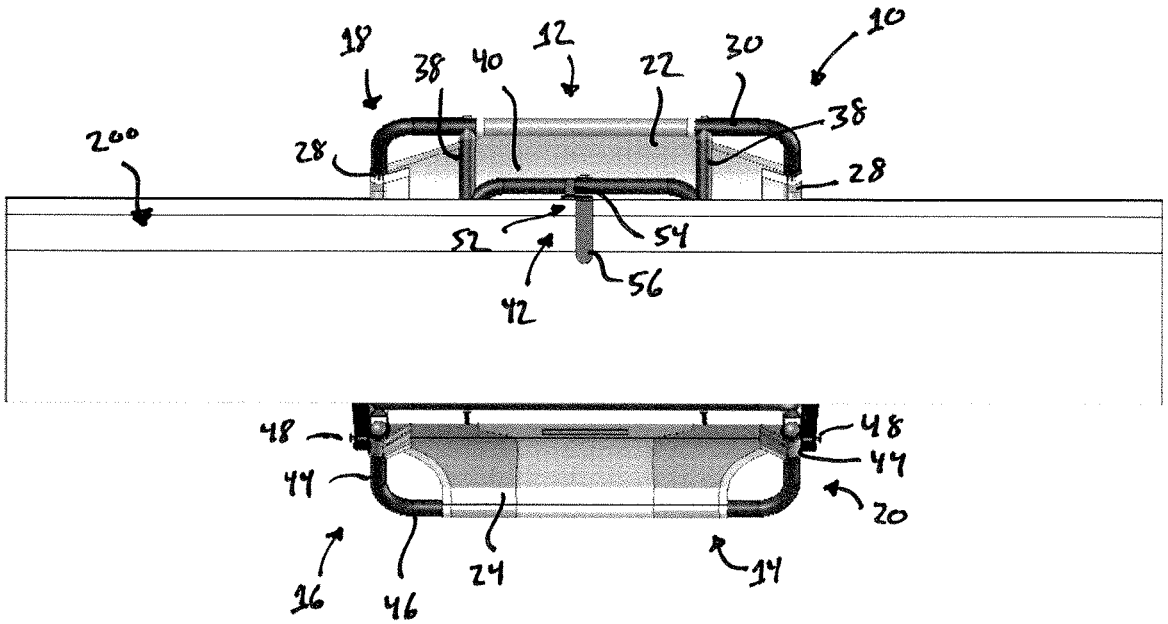
FIG. 19 is a bottom planar view of the stadium seat of FIG. 1 as positioned in accordance with FIG. 16.

Referring to FIG. 7, a second stop 54 is provided on the safety latch 42 normally disposed from the first stop 52 for helping support the safety latch 42 on the seat bottom frame 18 and for restricting the freedom of pivotal motion of the latch 42 in use. Additionally, the second stop 54 essentially secures or locks the latch 42 in its two positions for use—"up" and "down"—by engaging the cross-member 40 on the underside of the seat bottom support 12, and prevents the latch 42 from digging into the seat panel 22 above. For example, one position of the second stop 54 engaging the cross-member 40 in the retracted position of the latch 42 is illustrated in FIG. 12. The other position of the second stop 54, engaging the cross member 40 when the latch 42 is moved to its extended position, is illustrated in FIGS. 6 and 16.

Referring to FIGS. 7-8, the safety latch 42 includes a rearwardly extending arm 56 for use in the "down" or extended position of the latch 42. In use, this arm 56 is adapted to extend through an opening in the front face of a bleacher bench 200 and further to extend beneath the underside of the bleacher bench 200 to grasp onto the bleacher bench 200 to secure the seat 10 in place. In use, when the latch 42 is pivoted down, the seat 10 can be slid back until the surface of the first stop 52 (reoriented 90 degrees) contacts the front face of the bleacher bench 200. At this position, the arm 56 is positioned under the bleacher bench 200, with the bleacher bench 200 essentially being sandwiched between the arm 56 and the seat bottom frame 18, as illustrated in FIGS. 16-19. The first stop 52 and the arm 56 work to hold the stadium seat 10 in its desired position and further helps prevent the seat 10 from tipping backwards, especially when a seated users leans back on the back support 14. In embodiments of the present invention, the latch 42 can further be spring-biased to its "up" and "rest" retracted position so that when it is used in its "down" and extended position, it grabs onto the bleacher bench 200 and helps hold the stadium seat 10 in place.

In FIGS. 16-19, the seat 10 is shown set-up and positioned on a bleacher bench 200 with the safety latch 42 in its "down" and extended position. As noted, the seat 10 can also be safely used with the safety latch 42 in its "up" and "rest" retracted position simply by sliding the seat 10 back until the first stop 52 contacts the front face of the bleacher bench 200. For example, FIGS. 12-15 illustrate the seat 10 in a set-up condition and properly positioned on a bleacher bench 200 with the latch in its "up" and "rest" retracted position. By comparison, FIGS. 10-11 illustrate a situation where the seat 10 is positioned on a bleacher bench 200 with the safety latch 42 is its retracted position but located too far back on the seating surface of the bleacher bench 200, and thus not safely positioned. In accordance with the present invention, the extension of the first stop 52 inhibits the seat 10 from sitting flush on the seating surface when improperly positioned—the resultant wobble and lack of comfort alerts the user that the seat 10 must be repositioned.

Figure 21:
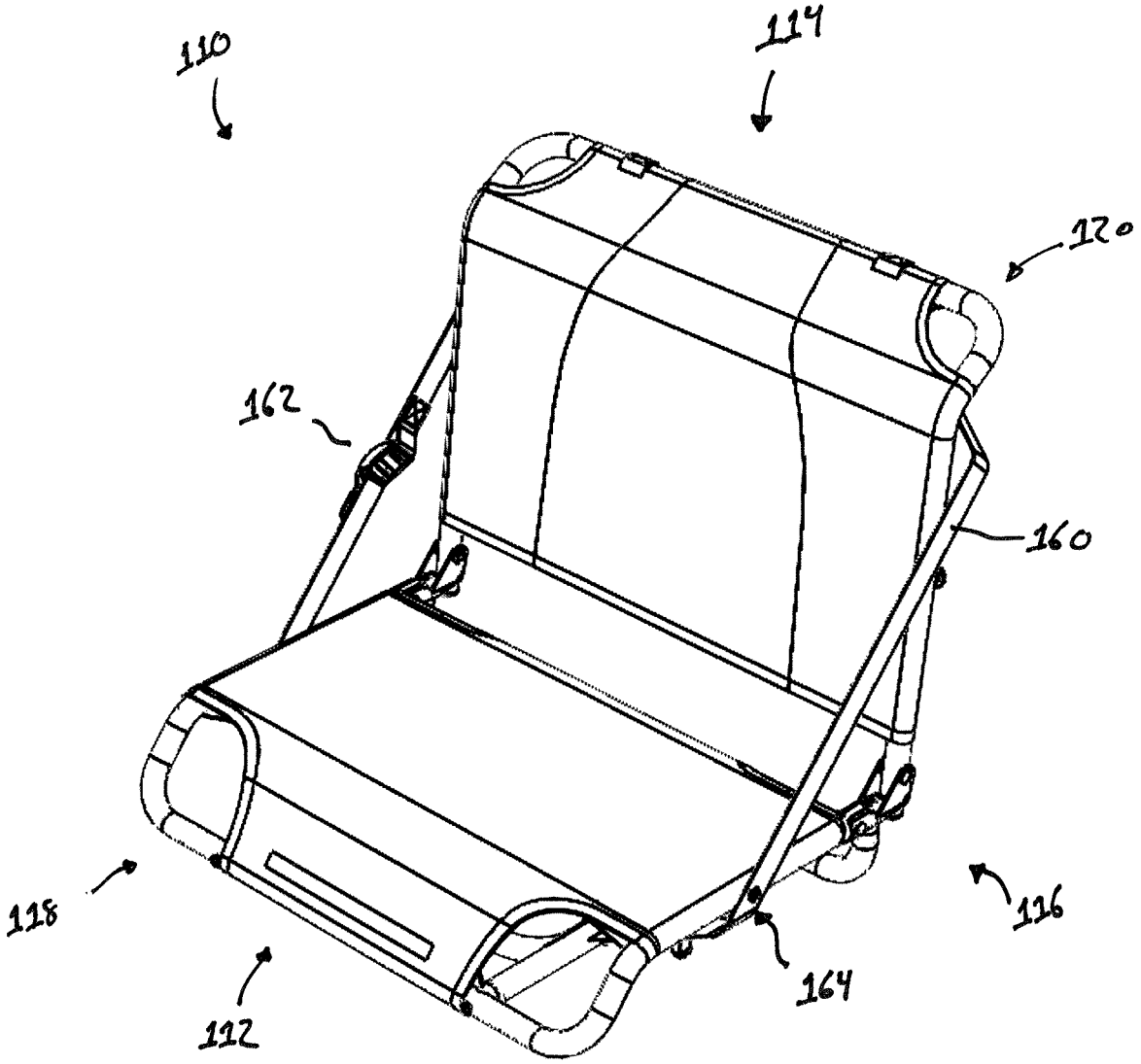
FIG. 21 is a front perspective view of a portable and collapsible stadium seat in accordance with another embodiment of the present invention shown in a set-up condition.
Figure 22:
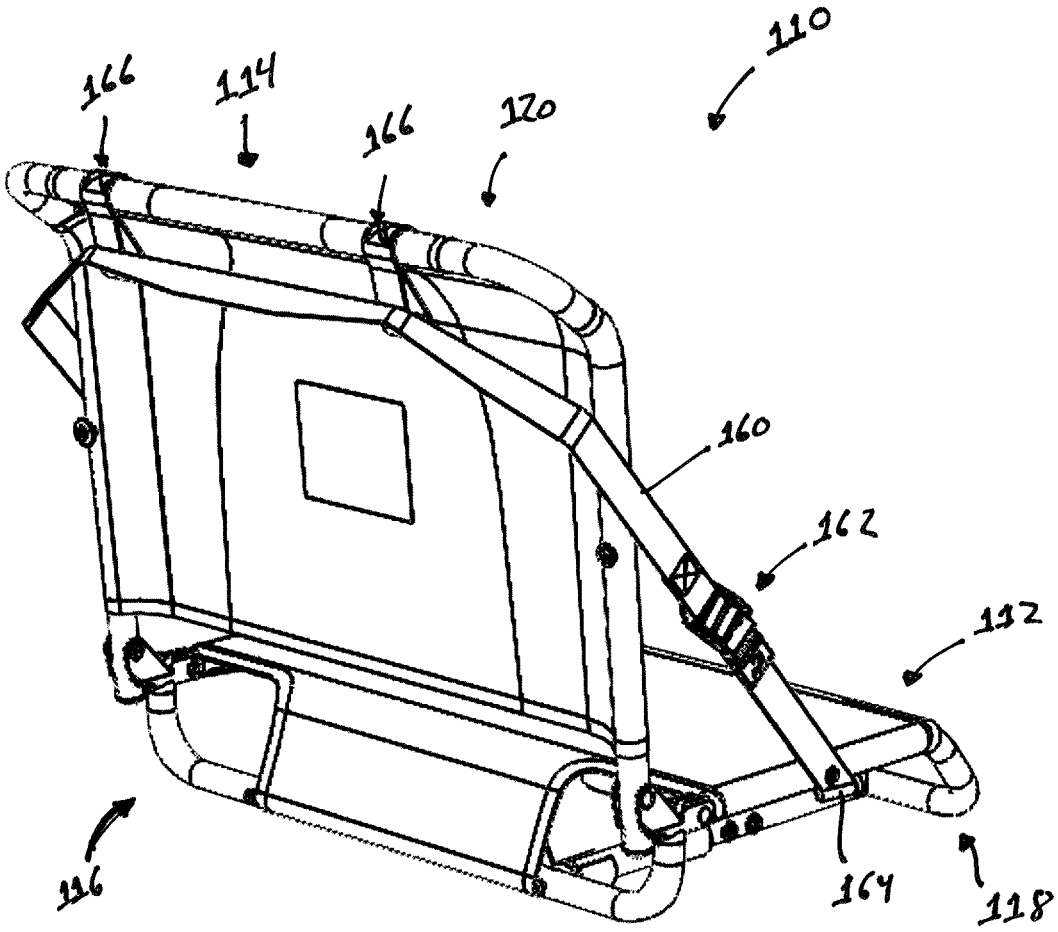
FIG. 22 is a rear perspective view of the stadium seat of FIG. 21.
Figure 23:
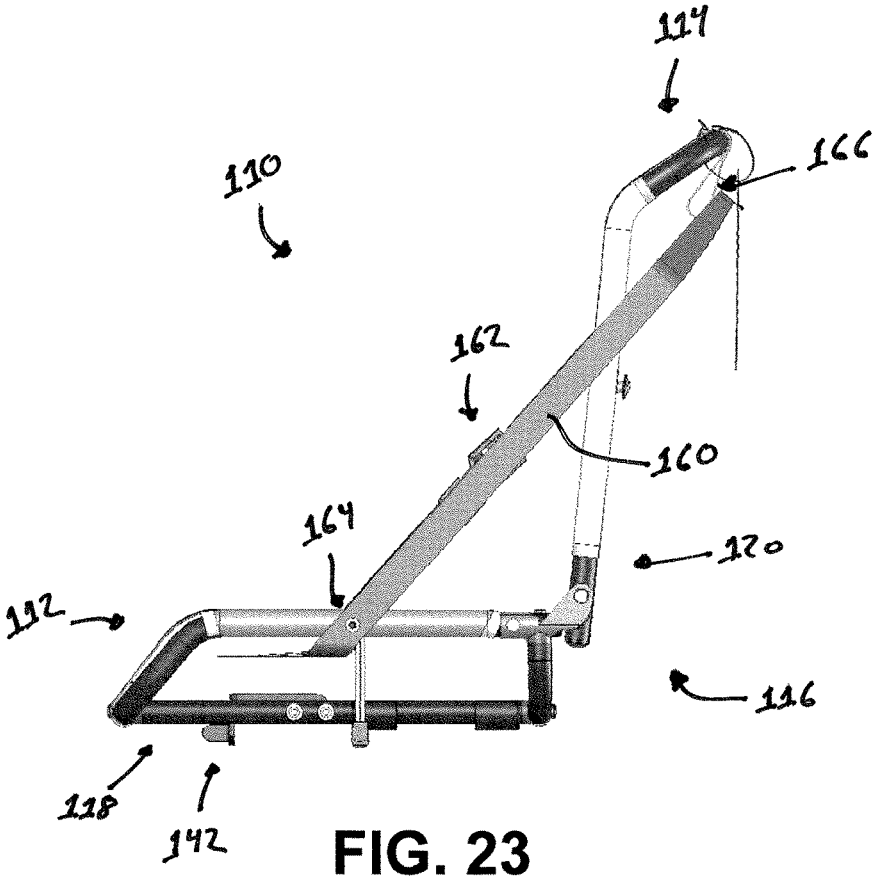
FIG. 23 is a side planar view of the stadium seat of FIG. 21 with a safety latch in accordance with the present invention in its "up" or retracted position.
Figure 24:
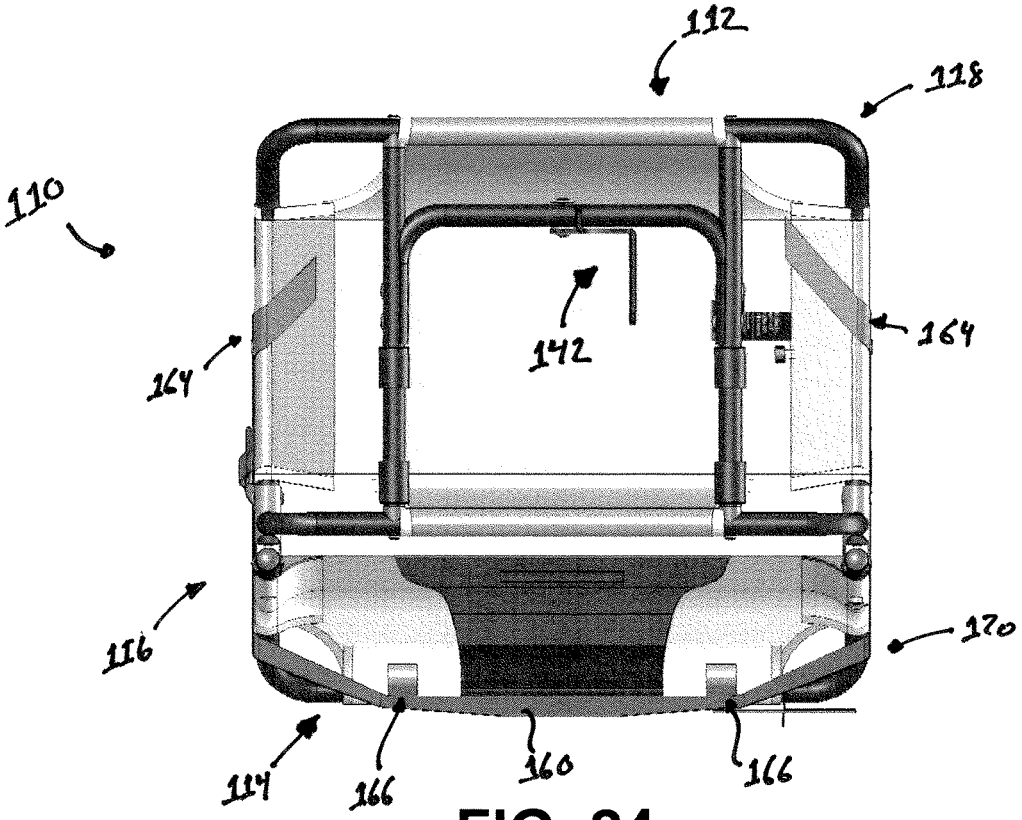
FIG. 24 is a bottom planar view of the stadium seat of FIG. 21 with the safety latch in its "up" or retracted position.
Figure 25:
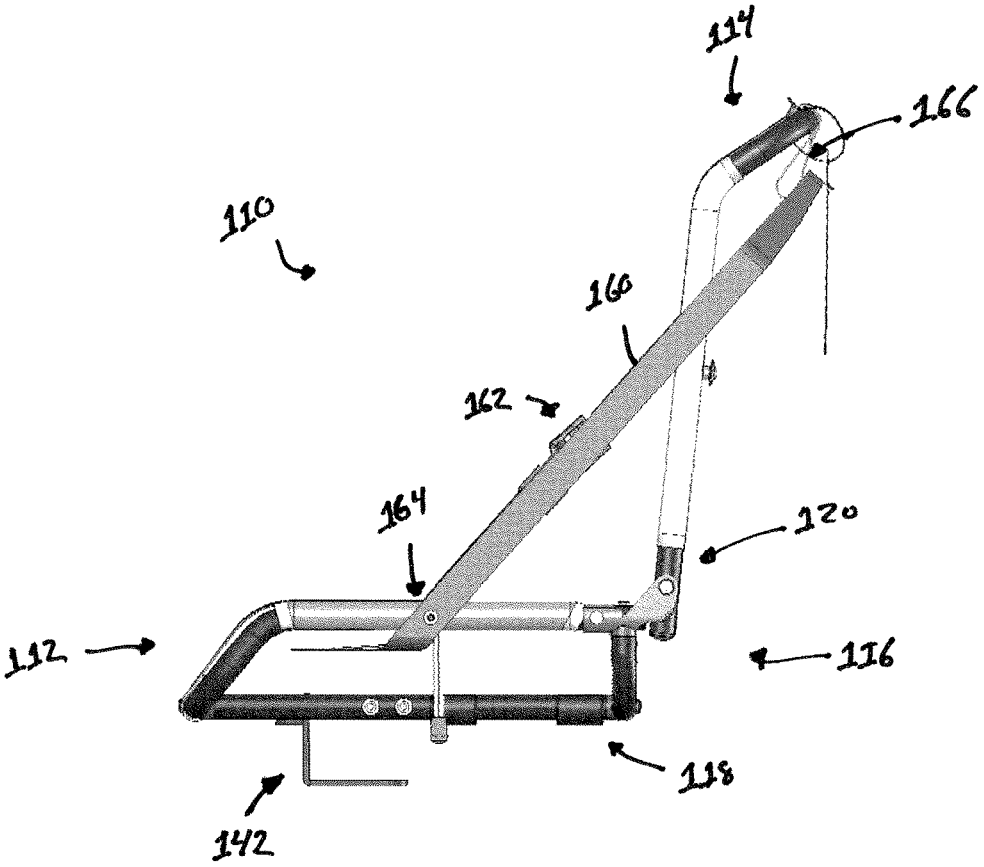
FIG. 25 is a side planar view of the stadium seat of FIG. 21 with the safety latch in its "down" or extended position.
Figure 26:
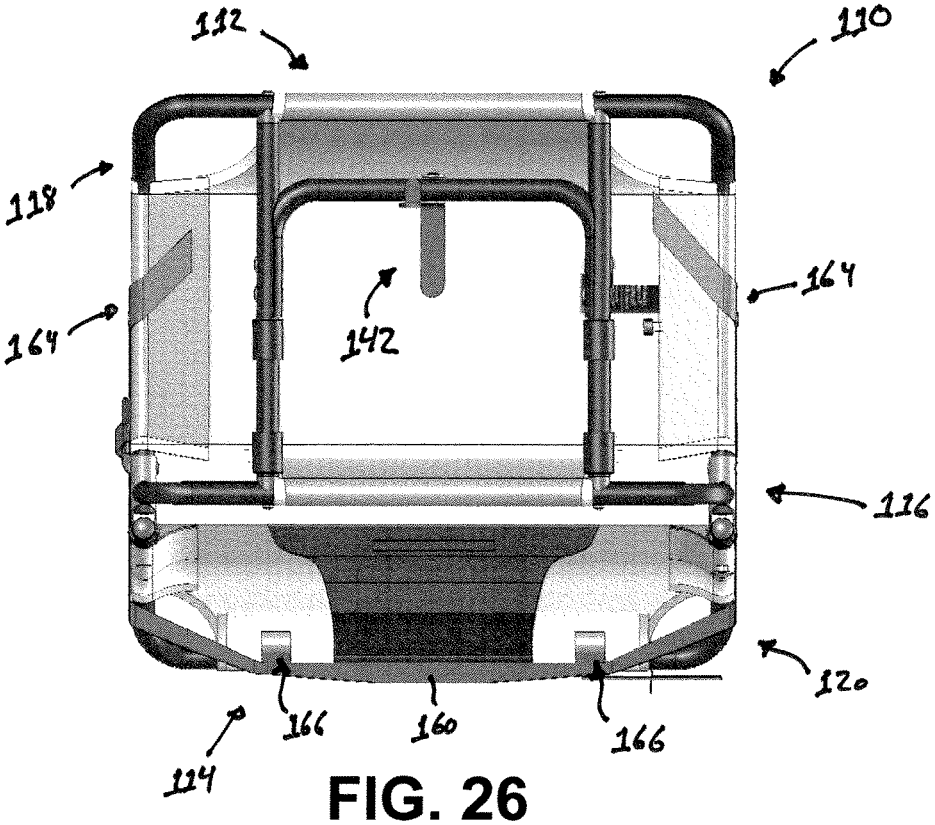
FIG. 26 is a bottom planar view of the stadium seat of FIG. 21 with the safety latch in its "down" or extended position.
Figure 27:
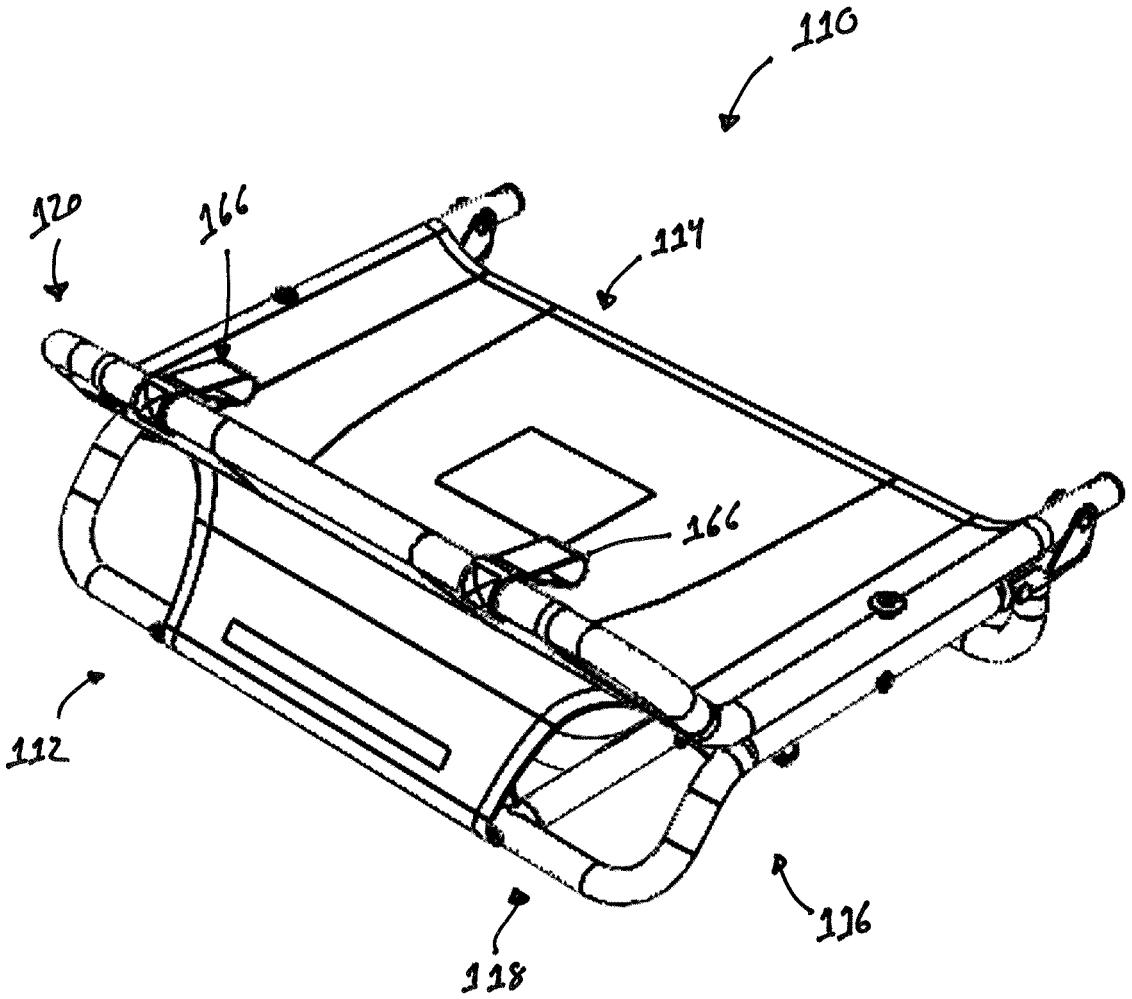
FIG. 27 is a perspective view of the stadium seat of FIG. 21 shown in a collapsed condition.
Figure 28:
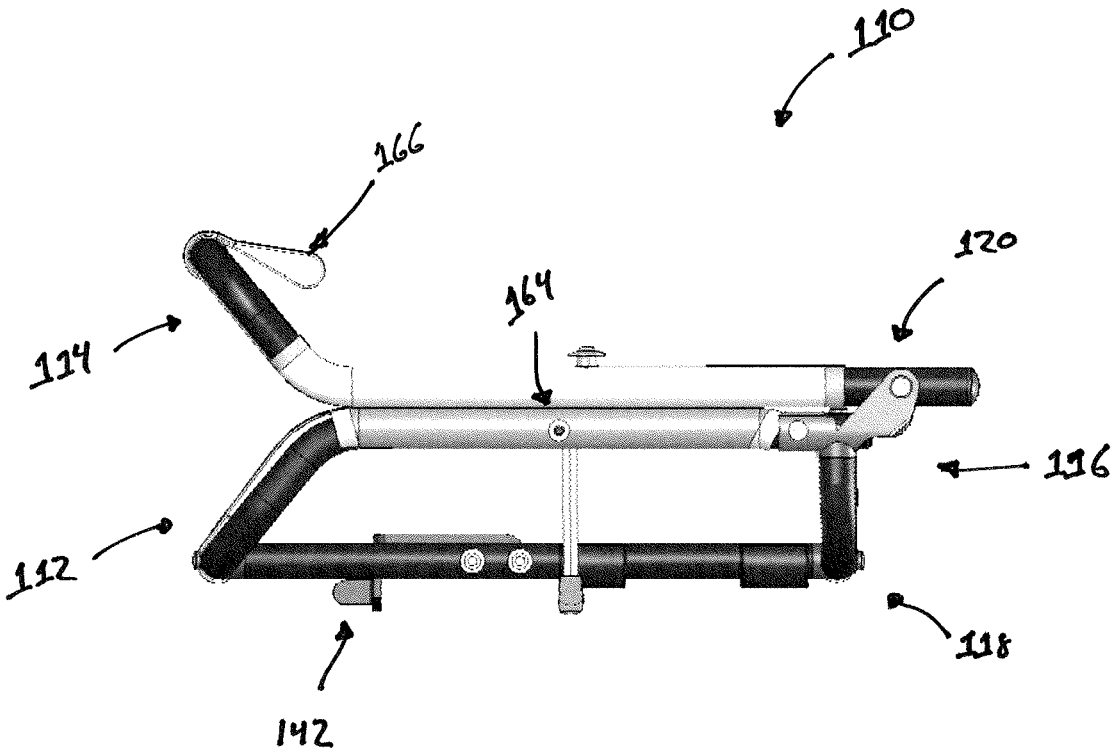
FIG. 28 is a side planar view of the collapsed stadium seat of FIG. 27.

Referring to FIGS. 21-28, an alternate embodiment of a stadium seat 110 in accordance with the present invention is illustrated. In this embodiment, similar components to the stadium seat 10 shown in FIG. 1 and described above are provided with similar reference numerals for ease of description. FIGS. 21-22 generally illustrate the seat 110 in a set-up condition. FIGS. 23-24 illustrate the seat 110 in the set-up condition with the safety latch 142 in its "up" or "rest" retracted position. FIGS. 25-26 illustrate the seat 110 in the set-up condition with the safety latch 142 in its "down" and extended position. FIGS. 27-28 illustrate the seat 110 in a collapsed condition.

In this alternate embodiment, the armrests 26 from the preferred embodiment are replaced with a strap 160 wrapped around the back support 114 of the seat 110 in the set-up condition. This strap 160 is similar to the strap design shown and described in Applicant's U.S. Pat. No. 5,779,314, entitled "Collapsible Multi-Purpose Chair," which is incorporated herein by reference in its entirety. When the seat 110 is in a folded and collapsed condition, the strap 160 is relaxed and can be used as a carrying strap, such as like a shoulder strap, to easily transport the collapsed seat 110. When the seat 110 is in its set-up or operative condition, as it appears in FIGS. 21-22, the back support 114 of the seat 110 is held and supported by the strap 160.

In a preferred embodiment, the strap 160 preferably comprises an assembly of two parts joined by a suitable adjustable fastener or buckle 162. The end portions of the strap assembly are respectively connected to opposite lateral sides of the seat bottom frame 118 by pivot pins 164. The strap 160 is then wrapped around the back support 114 when the seat 110 is in its set-up condition. The buckle 162 is preferably located in a readily accessible position at the side of the seat 110. A person seated in the seat 110 may adjust the angular position and tension of the back support 114 of the seat 110 from a seated position by releasing the buckle 162 and pulling in on or letting out the free end of a strap 160 to change the angular position of the back support 114 relative to the seat bottom support 112.

FIG. 22 illustrates loops 166 used to attach the strap 160 to the seat 110. As illustrated, at least two loops 166 are provided on the back of the back support 114 at spaced apart points of operable connection. The strap 160 is routed through the loops 166 and freely movable relative to the back support 114 at the points of operable connection between a back support retaining condition and a carrying condition. When the seat 110 is its set-up condition, the strap 160 becomes taut and acts to help support and position the back support 114, especially when a seated user leans back on the back support 114. When force is applied on the loops 166, which preferably are provided on the back of the back support 114, and more preferably at the top of the back support 114, as illustrated, the back support 114 is tensioned by the tautness of the strap 160. When the seat 110 is collapsed, the strap 160 relaxes and can be used as a carrying strap, such as like a shoulder strap.

When the seat 110 is resting on a seating surface (e.g., bleacher bench 200) in its set-up condition, it may be automatically collapsed to its collapsed condition by grasping a central portion of the strap 160 at the rear of the back support 114 and applying a lifting force to the strap 160 to move it to its carrying condition. When the seat 110 is lifted by the strap 160, the weight of the seat 110 borne by the strap 160 causes the seat bottom support 112, where the ends of the strap 160 are connected, to be pulled toward the back support 114. Thus, as the seat 110 is brought to a shoulder carrying position, it is automatically collapsed into a compact bundle, which may be easily supported and transported on the shoulder via the strap 160. Moreover, the weight of the seat 110 acting upon the strap 160 maintains the seat 110 in this compact bundle as long as it remains in a carrying condition. The seat 110 may be rapidly deployed from such a carrying condition to its set-up condition by reversing the motions generally afore-described. That is, when the seat 110 is unslung from the user's shoulder and grounded, the seat 110 may be readily opened by releasing the strap 160 and grasping the upper portion of the back support 114 and moving the back support 114 to a preferred position relative to the seat bottom support 112 to define a seating accommodation for the user.

The carrying strap 160 may also be used in a design of the stadium seat having armrests 26 without departing from the spirit and principles of the present invention.

The foregoing description of embodiments of the present invention has been presented for the purpose of illustration and description. It is not intended to be exhaustive or to limit the invention to the form disclosed. Obvious modifications and variations are possible in light of the above disclosure. The embodiments described were chosen to best illustrate the principles of the invention and practical applications thereof to enable one of ordinary skill in the art to utilize the invention in various embodiments and with various modifications as suited to the particular use contemplated.

What is claimed is:

1. A portable and collapsible stadium seat adapted to be mounted on a bleacher bench for use, said bleacher bench including a horizontal seating surface and a front face, said stadium seat comprising:

a seat bottom support;

a back support; and a safety latch mounted to the seat bottom support;

wherein the seat bottom support and the back support are interconnected for movement between a set-up condition defining a seating surface and a back support surface for receiving a seated user, and a collapsed condition where the seat bottom support and the back support are generally parallelly disposed adjacent to one another;

wherein the safety latch includes a first stop having a generally flat first stop surface defined in part by a curved edge, said first stop surface being adapted to abut the front face of the bleacher bench to position the stadium seat relative to the seating surface of the bleacher bench for use of the stadium seat in its set-up condition; and wherein further the first stop inhibits the ability of the stadium seat to sit flush on the seating surface of the bleacher bench if the stadium seat is positioned too far back on said seating surface, the curved edge of said first stop causing the stadium seat to wobble when said curved edge contacts the seating surface of the bleacher bench.

2. The portable and collapsible stadium seat according to claim 1, wherein the first stop is mounted to the underside of the seat bottom support.

3. The portable and collapsible stadium seat according to claim 2, wherein the first stop extends beyond a lower plane of the seat bottom support.

4. The portable and collapsible stadium seat according to claim 2, wherein the safety latch is movable between a retracted position and an extended position.

5. The portable and collapsible stadium seat according to claim 4, wherein the safety latch is pivotally movable between the retracted position and the extended position.

6. The portable and collapsible stadium seat according to claim 4, wherein the safety latch is spring-biased to its retracted position.

7. The portable and collapsible stadium seat according to claim 4, wherein the safety latch further comprises a rearwardly extending arm that can project through an opening in the front face of the bleacher bench when the safety latch is in its extended position and the stadium seat is placed atop the seating surface of the bleacher bench, wherein the rearwardly extending arm is normally disposed relative to the first stop surface.

8. The portable and collapsible stadium seat according to claim 7, wherein the safety latch further comprises a second stop projecting normally from the first stop and in an opposite direction from the rearwardly extending arm, said second stop adapted to interact with the seat bottom support to control movement of the safety latch between the retracted and extended positions thereof.

9. The portable and collapsible stadium seat according to claim 1, further comprising a pair of armrests being pivotable with movement of the seat bottom support and back support between the set-up and collapsed conditions of the stadium seat.

10. The portable and collapsible stadium seat according to claim 1, further comprising a carrying strap for transporting the stadium seat in its collapsed condition.

11. The portable and collapsible stadium seat according to claim 10, wherein the carrying strap comprises opposite ends connected to the lateral sides of the seat bottom support and wrapped around the back support, such that, when the stadium seat is in its set-up condition, the strap positions and supports the back support relative to the seat bottom support.

12. The portable and collapsible stadium seat according to claim 11, wherein the back support further comprises at least two loops provided on the back of the back support at spaced apart points of operable connection, said strap being routed through said loops and freely movable relative to said back support at said points of operable connection between back support retaining and carrying conditions.

13. A portable and collapsible stadium seat adapted to be mounted on a bleacher bench for use, said bleacher bench including a horizontal seating surface and a front face, said stadium seat comprising:

a seat bottom support;

a back support;

a pair of armrests; and a safety latch mounted to the underside of the seat bottom support for movement between a retracted position and an extended position;

wherein the seat bottom support and the back support are interconnected for movement between a set-up condition defining a seating surface and a back support surface for receiving a seated user, and a collapsed condition where the seat bottom support and the back support are generally parallelly disposed adjacent to one another;

wherein the pair of armrests are pivotable with movement of the seat bottom support and back support between the set-up and collapsed conditions of the stadium seat;

wherein the safety latch includes a first stop having a generally flat first stop surface defined in part by a curved edge, said curved edge being generally downwardly facing when said safety latch is in its retracted position and said curved edge being generally transversely facing when said safety latch is in its extended position, said first stop surface being adapted to abut the front face of the bleacher bench to position the stadium seat relative to the seating surface of the bleacher bench for use of the stadium seat in its set-up condition whether the safety latch is in its retracted position or its extended position; and wherein further the first stop inhibits the ability of the stadium seat to sit flush on the seating surface of the bleacher bench when the safety latch is in its retracted position if the stadium seat is positioned too far back on said seating surface, the curved edge of said first stop causing the stadium seat to wobble when said curved edge contacts the seating surface of the bleacher bench.

14. The portable and collapsible stadium seat according to claim 13, wherein the first stop extends beyond a lower plane of the seat bottom support when the safety latch is in its retracted position.

15. The portable and collapsible stadium seat according to claim 13, wherein the safety latch further comprises a rearwardly extending arm that can project through an opening in the front face of the bleacher bench when the safety latch is in its extended position and the stadium seat is placed atop the seating surface of the bleacher bench, wherein the rearwardly extending arm is normally disposed relative to the first stop surface.

16. The portable and collapsible stadium seat according to claim 15, wherein the safety latch further comprises a second stop projecting normally from the first stop and in an opposite direction from the rearwardly extending arm, said second stop adapted to interact with the seat bottom support to control movement of the safety latch between the retracted and extended positions thereof.

17. The portable and collapsible stadium seat according to claim 13, further comprising a carrying strap for transporting the stadium seat in its collapsed condition.

18. A portable and collapsible stadium seat adapted to be mounted on a bleacher bench for use, said bleacher bench including a horizontal seating surface and a front face, said stadium seat comprising:

a seat bottom support;

a back support:

a carrying strap for transporting the stadium seat; and a safety latch mounted to the underside of the seat bottom support for movement between a retracted position and an extended position;

wherein the seat bottom support and the back support are interconnected for movement between a set-up condition defining a seating surface and a back support surface for receiving a seated user, and a collapsed condition where the seat bottom support and the back support are generally parallelly disposed adjacent to one another and can be transported via the carrying strap;

wherein said strap comprising opposite ends connected to the lateral sides of the seat bottom support and wrapped around the back support when the stadium seat is in its set-up condition such that, in said set-up condition, the strap positions and supports the back support relative to the seat bottom support;

wherein the safety latch includes a first stop having a generally flat first stop surface defined in part by a curved edge, said curved edge being generally downwardly facing when said safety latch is in its retracted position and said curved edge being generally transversely facing when said safety latch is in its extended position, said first stop surface being adapted to abut the front face of the bleacher bench to position the stadium seat relative to the seating surface of the bleacher bench for use of the stadium seat in its set-up condition whether the safety latch is in its retracted position or its extended position; and wherein further the first stop inhibits the ability of the stadium seat to sit flush on the seating surface of the bleacher bench when the safety latch is in its retracted position if the stadium seat is positioned too far back on said seating surface, the curved edge of said first stop causing the stadium seat to wobble when said curved edge contacts the seating surface of the bleacher bench.

19. The portable and collapsible stadium seat according to claim 18, wherein the back support further comprises at least two loops provided on the back of the back support at spaced apart points of operable connection, said strap being routed through said loops and freely movable relative to said back support at said points of operable connection between back support retaining and carrying conditions for supporting said back support relative to the seat bottom support when said strap is in its back support retaining condition relative to said stadium seat and for moving said stadium seat from its set-up condition to its collapsed condition in response to a lifting force applied to the strap to move said strap to its carrying condition.

20. The portable and collapsible stadium seat according to claim 18, wherein the safety latch further comprises a rearwardly extending arm that can project through an opening in the front face of the bleacher bench when the safety latch is in its extended position and the stadium seat is placed atop the seating surface of the bleacher bench, wherein the rearwardly extending arm is normally disposed relative to the first stop surface.

21. The portable and collapsible stadium seat according to claim 20, wherein the safety latch further comprises a second stop projecting normally from the first stop and in an opposite direction from the rearwardly extending arm, said second stop adapted to interact with the seat bottom support to control movement of the safety latch between the retracted and extended positions thereof.

* * * * *